US007861491B2

(12) United States Patent
Yuyama et al.

(10) Patent No.: US 7,861,491 B2
(45) Date of Patent: Jan. 4, 2011

(54) MEDICINE DISPENSING/PACKAGING APPARATUS

(75) Inventors: Shoji Yuyama, Osaka (JP); Hiroshi Hashimoto, Osaka (JP); Hiromichi Tsuda, Osaka (JP); Takashi Ueno, Osaka (JP)

(73) Assignee: Yuyama Mfg. Co., Ltd., Toyonaka-shi (JP)

( * ) Notice: Subject to any disclaimer, the term of this patent is extended or adjusted under 35 U.S.C. 154(b) by 0 days.

(21) Appl. No.: 12/553,745

(22) Filed: Sep. 3, 2009

(65) Prior Publication Data

US 2010/0059141 A1 Mar. 11, 2010

Related U.S. Application Data

(63) Continuation of application No. 11/916,038, filed as application No. PCT/JP2006/310697 on May 29, 2006, now Pat. No. 7,726,095.

(30) Foreign Application Priority Data

May 31, 2005 (JP) ..... 2005-159847
May 26, 2006 (JP) ..... 2006-147026

(51) Int. Cl.
*B65B 1/36* (2006.01)
*B65B 1/30* (2006.01)

(52) U.S. Cl. ..... 53/52; 53/503; 53/77; 53/550; 53/244; 221/83; 222/362

(58) Field of Classification Search ..... 53/52, 53/503, 77, 158, 545, 548, 550, 244; 221/83–85, 221/90, 209, 253, 258, 264, 265; 222/361, 222/362, 371; *B65B 1/30, 1/36, 37/16, 37/20*
See application file for complete search history.

(56) References Cited

U.S. PATENT DOCUMENTS 4,573,606 A 3/1986 Lewis et al.
5,340,949 A * 8/1994 Fujimura et al. ..... 222/77
6,170,699 B1 1/2001 Kim
6,449,921 B1 9/2002 Kim
6,772,907 B2 8/2004 Kim

FOREIGN PATENT DOCUMENTS

GB 2038766 A * 7/1980

(Continued)

*Primary Examiner*—Stephen F Gerrity
(74) *Attorney, Agent, or Firm*—Oblon, Spivak, McClelland, Maier & Neustadt, L.L.P.

(57) ABSTRACT

A powder medicine dispensing/packaging apparatus includes: a divisional container composed of a first divisional container and a second divisional container connectable to each other and each including a plurality of powder medicine accommodation parts accommodating powder medicine in equal amounts corresponding to one package, each powder medicine accommodation part being equipped with a bottom plate that can be opened and closed; a carrying device for horizontally carrying the divisional container between an initial position and a first movement terminal position; a dispensing/packaging device for recovering powder medicine dropped from the divisional container carried by the carrying device by successively opening the bottom plates and dispensing/packaging the powder medicine package by package; and a swinging device for canceling the connection between the first divisional container and the second divisional container at the first movement terminal position to enable the first divisional container to move to a second movement terminal position and swinging the second divisional container to a retracted position.

4 Claims, 24 Drawing Sheets

FOREIGN PATENT DOCUMENTS

| | | | | |
|---|---|---|---|---|
| JP | 57023536 | A | * | 2/1982 |
| JP | 58-90003 | | | 5/1983 |
| JP | 61-27243 | | | 6/1986 |
| JP | 03085215 | A | * | 4/1991 |
| JP | 09-118303 | | | 5/1997 |
| JP | 09-118313 | | | 5/1997 |
| JP | 10-16917 | | | 1/1998 |
| JP | 2939139 | | | 6/1999 |
| JP | 2001039401 | A | * | 2/2001 |
| JP | 2002-017820 | | | 1/2002 |
| JP | 2002-019704 | | | 1/2002 |
| JP | 2002284101 | A | * | 10/2002 |
| JP | 3400940 | | | 2/2003 |
| JP | 2003146301 | A | * | 5/2003 |
| JP | 3527179 | | | 2/2004 |
| JP | 2004113506 | A | * | 4/2004 |
| JP | 2004215778 | A | * | 8/2004 |

* cited by examiner

MEDICINE DISPENSING/PACKAGING APPARATUS

CROSS-REFERENCE TO RELATED APPLICATIONS

This application is a continuation of U.S. patent application Ser. No. 11/916,038, filed on Nov. 30, 2007, now U.S. Pat. No. 7,726,095, the entire content of which is incorporated herein by reference. U.S. patent application Ser. No. 11/916,038 is the National Stage of PCT/JP06/310697, filed on May 29, 2006, which claims priority to Japanese Application No. 2005-159847, filed on May 31, 2005 and Japanese Application No. 2006-147026, filed on May 26, 2006.

TECHNICAL FIELD

The present invention relates to a medicine dispensing/packaging apparatus.

BACKGROUND ART

Conventionally there has been proposed a construction in which a powder medicine dispenser box is divided into a front half portion situated on one side of its moving direction and a rear half portion situated on the other side thereof and in which there is provided at the one side of a powder medicine dispenser box movement path a lift mechanism by means of which the powder medicine dispenser box front half portion is upwardly retracted from the power medicine dispenser box movement path after passing a medicine discharge position to secure a movement space for the powder medicine dispenser box rear half portion, the power medicine dispenser box front half portion being restored to the space after the use of the space (see, for example, Patent Document 1).

Further, there has been proposed another construction in which powder medicine dispenser box movement paths are provided in upper and lower stages and in which power medicine dispenser boxes are respectively provided in the upper and lower powder medicine dispenser box movement paths so as to be movable, with the upper and lower powder medicine dispenser box movement paths sharing the same medicine discharge position, and the medicine charging positions of the upper and lower powder medicine dispenser box movement paths being horizontally deviated from each other (see, for example, Patent Document 2).

Further, there has been proposed a tablet dispensing/packaging apparatus equipped with a tablet conveying portion in which there is conveyed in a horizontal direction and then in a vertical direction along a guide rail a tablet accommodation part connection body in which there are arranged a large number of tablet accommodation parts each having an upper opening and a bottom plate discharge port with an opening/closing means and in which adjacent lower portions are pin-connected together (see, for example, Patent Document 3).

Further, there has been proposed a construction in which the construction as disclosed in Patent Document 3 is applied as a powder medicine divisional conveyance portion.

Patent Document 1: JP 2686430 B
Patent Document 2: JP 2711087 B
Patent Document 3: JP 3527179 B
Patent Document 4: JP 3409023 B

DISCLOSURE OF THE INVENTION

Problems to be Solved by the Invention

It is an object of the present invention to provide a powder medicine dispensing/packaging apparatus which has a compact construction while, if some powder medicine should remain in the second divisional container, the residual powder medicine will fall and not be mixed with the powder medicine in the first divisional container.

Means for Solving the Problems

According to the present invention, as means for solving the above-mentioned problems, there is provided a powder medicine dispensing/packaging apparatus including: a divisional container composed of a first divisional container and a second divisional container connectable to each other and each including a plurality of powder medicine accommodation parts accommodating powder medicine in equal amounts corresponding to one package, each powder medicine accommodation part being equipped with a bottom plate that can be opened and closed; a carrying means for horizontally carrying the divisional container between an initial position and a first movement terminal position; a dispensing/packaging means for recovering powder medicine dropped from the divisional container carried by the carrying means by successively opening the bottom plates and dispensing/packaging the powder medicine package by package; and a swinging means for canceling the connection between the first divisional container and the second divisional container at the first movement terminal position to enable the first divisional container to move to a second movement terminal position and swinging the second divisional container to a retracted position.

Due to the above construction, it is only necessary to secure a space allowing reciprocating movement of the divisional container between the initial position and the first movement terminal position, so it is possible to realize a compact construction. Further, as a result of its swinging, the second divisional container comes to be situated above and sidewise with respect to the first divisional container moved to the second movement terminal point. That is, the second divisional container is moved to a position not right above the first divisional container but deviated sidewise therefrom, so if some powder medicine should remain in the second divisional container, the residual powder medicine will fall and not be mixed with the powder medicine in the first divisional container.

The first divisional container is supported so as to be capable of reciprocating along a first slide rail, the second divisional container is supported so as to be capable of reciprocating along a second slide rail provided in parallel with the first slide rail, and the second slide rail is supported so as to be swingable with respect to the first slide rail.

It is desirable to further provide a means which determines that there is an error if, when restoring the second divisional container to the first movement terminal position from the retracted position, the second divisional container is situated at the first movement terminal position as a result of moving the first divisional container to the initial position after moving the first divisional container from the second movement terminal position to the first movement terminal position.

Effects of the Invention

According to the present invention, it is only necessary to secure a space allowing reciprocating movement of the divisional container between the initial position and the first movement terminal position, so it is possible to realize a compact construction. Further, the second divisional container is moved to a position not right above the first divisional container but deviated sidewise therefrom, so if some powder medicine should remain in the second divisional container, the residual powder medicine will fall and not be mixed with the powder medicine in the first divisional container.

BEST MODE FOR CARRYING OUT THE INVENTION

In the following, an embodiment of the present invention will be described with reference to the accompanying drawings.

(Construction)

FIGS. 1A and 2A show a medicine dispensing/packaging apparatus according to this embodiment. Roughly speaking, the medicine dispensing/packaging apparatus includes an apparatus main body 1 provided with a tablet feed unit 2, a powder medicine feed unit 3, and a dispensing/packaging unit 4.

(1 Tablet Feed Unit)

As shown in FIGS. 3 through 6, in the tablet feed unit 2, a tablet accommodation member 5 is detachably attached to a holding member 6.

(1-1 Tablet Accommodation Member)

As shown in FIGS. 7, a tablet accommodation member 5 includes a plurality of tablet accommodation parts 7 rotatably and continuously connected together. Each tablet accommodation part 7 is substantially rectangular in plan view, and has three tablet dispenser boxes 8 arranged longitudinally side by side. Further, a flange portion 9 extends from three sides of the upper peripheral edge portion of each tablet accommodation part 7. From both longitudinal ends of the flange portion 9, there extend support walls 10 downwardly from the front halves of the end edge portions. A through-hole 10*a* is formed at the lower end of each support wall 10, and a cutout 10*b* is formed in the vicinity thereof. As described below, a connection plate 17 is situated at the cutout 10*b*, stabilizing the mounting of the tablet accommodation member 5 to the holding member 6. Further, at both longitudinal ends of the flange portion 9, there protrude lock portions 11 extending downwardly from the centers of the edge portions at the rear of the support walls 10. The distal ends of the lock portions 11 each have an arcuately swollen sectional configuration. Below the lock portions 11, there are formed base portions 12. A protrusion 12*a* is formed on the outer surface of each base portion 12. Further, in the inner surface of each base portion 12, there is formed an engagement hole (not shown) at a position corresponding to the protrusion 12*a*. Further, the tablet accommodation parts 7 are arranged side by side in the lateral direction, and the protrusions 12*a* of one of two adjacent tablet accommodation parts 7 are rotatably engaged with the through-holes 10*a* of the other thereof, whereby the tablet accommodation parts 7 are continuously connected together so as to be rotatable.

As shown in FIG. 8, each of the tablet dispenser boxes 8 is formed as a rectangular tube inclined toward the lower end. The reason for inclining the tablet dispenser boxes 8 is to take into account their positional relationship with a hopper into which the accommodated tablets are to be dropped and to facilitate the extraction of erroneously accommodated tablets. As shown in FIGS. 9, the opening at the lower end of each tablet dispenser box 8 is opened and closed by a bottom plate 13. Each bottom plate 13 has protrusions 13*a* at both ends of one side thereof. The protrusions 13*a* are rotatably engaged with engagement holes (not shown). As a result, the bottom plates 13 can rotate about axes coinciding with the axes of the continuous connection of the tablet accommodation parts 7. Thus, when each tablet accommodation part 7 moves through an arcuate passage 61 described below, the bottom plates 13 easily follow the bottom surfaces of the tablet accommodation parts 7, so it is not necessary for the space of the arcuate passage 61 to be rather large. Further, weights 14 are mounted to the bottom surfaces of the bottom plates 13. The weights 14 allow the bottom plates 13 to rotate vertically due to their own weight, allowing the bottoms of the tablet dispenser boxes 8 to be reliably opened.

(1-2 Holding Member)

As shown in FIGS. 9, the holding member 6 continuously connects together holding parts 15 arranged in parallel so as to allow them to rotate. In each holding part 15, side plates 16 arranged opposite to each other at predetermined intervals are connected by a connection plate 17. The connection plate 17 is formed as a plate whose both end portions are bent in the same direction perpendicular thereto, with the both end portions being integrated with the side plates 16. The holding part 15 situated at one end of the holding member 6 has a release recess 15*a*, making it possible to provide the requisite space for allowing insertion of a finger when detaching the tablet accommodation member 5 mounted to the holding member 6. The holding part 15 situated at the other end of the holding member 6 has a dimension in the side-by-side arrangement direction set larger than that of the other holding parts 15. As a result, when supplying tablets from the last tablet accommodation part 7 by increasing the feed amount of the tablet accommodation member 5, it is possible to move the bottom plates 13 to positions where their opening is possible when supplying tablets from the last tablet accommodation part 7. Further, a gap is formed between the tablet accommodation part 7 and the holding part 15 to provide a space for inserting a finger as in the case of the above-mentioned release recess 15*a*.

Further, as shown in FIG. 5A, the holding member 6 has a cylindrical shaft member 18 arranged on the outer surface of the side plate 16 and three detection members 19 protruding therefrom. A support roller 20 is mounted to the shaft member 18. The detection members 19 are detected by a position detecting sensor 67 (Here, a photo sensor is used as the position detecting sensor 67), whereby the position of each tablet dispenser box 8 is identified. Since the detection members 19 directly provided on the holding member 6 are directly detected, it is possible to correctly identify the position of each tablet dispenser box 8 solely by appropriately mounting the tablet accommodation member 5 to the holding member 6. Further, a rectangular hole 21 is formed at one end of the side plate 16, and a lock reception portion 22 is formed in the vicinity thereof. The lock reception portion 22 is composed of a pair of elastic members 22*a* opposed to each other at a predetermined interval. Further, the lock portion 11 formed on each tablet accommodation part 7 can be engaged/disengaged with/from the lock reception portion 22. Further, first rack gears 23 are integrated with the outer surfaces of the side plates. Each first rack gear 23 has a gear portion at the lower edge thereof, and the gear portion continuously extends with the holding parts 15 arranged side by side in a straight line. The gear portion is in mesh with a pinion gear 24. The pinion gear 24 is engaged with a drive gear 26 through the intermediation of an intermediate gear 25. The drive gear 26 is formed on a rotation shaft 28 to which the drive force is transmitted from a feed motor 27 mounted to a frame member 56 described below.

As shown in FIG. 5B, as the construction for positional detection of each tablet dispenser box 8, it is also possible to adopt a construction including a detection disc 29 and a sensor 29*b* instead of the construction including the detection members 19 and the position detecting sensor 67. The detection disc 29 is mounted to a rotation shaft 28. Detection holes 29*a* are formed circumferentially at a predetermined pitch in the detection disc 29. Further, a sensor 29*b* detects the detection holes 29*a* to identify the feed position of each tablet accommodation part 7.

(2 Powder Medicine Feed Unit)

As shown in FIG. 3, the powder machine feed unit 3 is equipped with a V-shaped dispenser box 30 and a divisional container 31.

(2-1 V-shaped Dispenser Box)

The V-shaped dispenser box is formed by fixing end plates 33 to the end portions of a vertical plate 32 and providing an opening/closing plate 34 such that its lower edge can move toward and away from the vertical plate 32. Between the opening/closing plate 34 and the vertical plate 32, there is provided a partition triangular plate 35, which is moved toward the end plates 33, whereby it is possible to adjust the number into which the medicine is to be divided. At one end of the V-shaped dispenser box 30, there is provided a suction duct 66, making it possible to effect suction from a lower opening by a cleaner (not shown). Further, any residual powder medicine is sucked and removed from each powder medicine accommodation part 36 of the divisional container 31.

Further, an LED 80 is provided at one end of the V-shaped dispenser box 30. The display state of the LED 80 varies according to the driving condition of the divisional container 31. Here, the display state is one of three states of "blue lighting," "red lighting," and "red blinking." The "blue lighting" indicates that the divisional container is situated below the V-shaped dispenser box, and that dropping of the powder medicine in the V-shaped dispenser box is possible. The "red lighting" indicates that the divisional container is not ready but is performing some other operation. That is, it indicates that dispensing/packaging is going on, with powder medicine being successively fed from each divisional container to the dispensing/packaging unit, or that cleaning operation after dispensing/packaging is going on, with residual medicine being sucked and removed, or that there has been caused an error in which the stop position of the divisional container below the V-shaped dispenser box is not proper. The "red blinking" indicates that the display state is to be turned into "blue lighting" in a short period of time. It indicates that dispensing/packaging and cleaning have been completed, and that the divisional container is being moved according to the partitioning position of the partition plate. From the lighting state of the LED 80, the operator can ascertain at a glance what state the medicine dispensing/packaging apparatus is in.

(2-2 Divisional Container)

As shown in FIGS. 10 through 13, the divisional container 31 is formed by arranging powder medicine accommodation parts 36 side by side and integrating them together, and is composed of a first divisional container 31*a* including twelve powder medicine accommodation parts 36, and a second divisional container 31*b* including nine powder medicine accommodation parts 36. In the divisional containers 31*a*, 31*b*, the width dimension (the opening width in the side-by-side arrangement direction) of the powder medicine accommodation parts 36 situated at the ends is larger than that of the other powder medicine accommodation parts. As a result, the powder medicine is prevented from being scattered outwardly sideways from the end surfaces of the V-shaped dispenser box 30 when causing the powder medicine to fall from the V-shaped dispenser box 30. A first support bracket 37*a* is integrated with the first divisional container 31*a*, and a second support bracket 37*b* is integrated with the second divisional container 31*b*. As shown in FIGS. 14 and 15, respectively formed on the brackets 37*a*, 37*b* are second rack gears 38*a*, 38*b* extending continuously with the divisional containers 31*a*, 31*b* aligned in a row. The second rack gears 38*a*, 38*b* are in mesh with a pinion gear 101 provided on the rotation shaft of a feed motor 100 fixed to the apparatus main body 1. As a result, when the feed motor 100 is driven to make normal and reverse rotation, the divisional containers 31*a*, 31*b* reciprocate horizontally via the gears. As the feed motor 100, a pulse motor or the like is used.

Connecting portions 39*a* and 39*b* are respectively formed on the first support bracket 37*a* and the second support bracket 37*b*. The connecting portions 39*a*, 39*b* protrude in a hook-like fashion, allowing sidewise mesh-engagement alone. Thus, when, in the state in which the first divisional container 31*a* and the second divisional container 31*b* are continuously connected in a row, the second divisional container 31*b* is swung, the connection of the connecting portions 39*a*, 39*b* is canceled, and, when the second divisional container 31*b* is swung back to the former position, both can be connected together.

Further, a first portion 40*a* to be detected is provided at one end of the first divisional container 31*a*, and a second portion 40*b* to be detected is provided at the other end thereof. A third portion 40*c* to be detected is provided at one end of the second divisional container. The first portion 40*a* to be detected is detected by a first detection sensor 41*a* provided on the apparatus main body 1, thereby identifying the initial position of the divisional container 31. The second and third portions 40*b* and 40*c* to be detected are detected by the second detection sensor 41*b*, thereby identifying the first and second movement terminal positions.

The first support bracket 37*a* has two guide protrusions 42 on the back surface thereof. The guide protrusions 42 each have a substantially T-shaped sectional configuration, and are slidably mounted to a first slide rail 47*a* described below. Further, the second support bracket 37*b* is equipped with a support plate 43 protruding from the upper portion of the back surface to the back surface of the second divisional container 31*b*. A support plate 43 has four guide rollers 44 on the lower surface thereof. Each guide roller 44 is fixed in position by utilizing an elongated hole 44*a*. The guide rollers 44 situated at the longitudinal ends of the support plate 43 and the guide rollers 44 situated on the inner side thereof are laterally offset from each other. Each guide roller 44 has a groove in the outer peripheral surface thereof, and a protruding portion of a second slide rail 47*b* described below is situated in this groove. The guide rollers 44 can be easily removed from the second slide rail 47*b* solely by shifting the position of each guide roller 44 in the lateral direction of the support plate 43 utilizing the elongated hole 44*a*.

The brackets 37*a*, 37*b* are supported by a guide member 45 so as to be capable of reciprocating. The guide member 45 is composed of a first guide portion 46*a* and a second guide portion 46*b* arranged on the back side thereof.

The first guide portion 46*a* has on its front surface a first slide rail 47*a* on which the guide protrusions 42 of the first bracket 37*a* slide. The upper and lower edge portions of the first slide rail 47*a* protrude in a hook-like fashion toward each other, supporting the first divisional container 31*a* so as to allow the first divisional container 31*a* to horizontally reciprocate by guiding the guide protrusions 42.

The second guide portion 46*b* is equipped with a guide shaft 48 and a second slide rail 47*b* fixed to the guide shaft 48, and is arranged on the back side of the first guide portion 46*a*. Both end portions of the guide shaft 48 are rotatably mounted to a mounting plate 49 and a support plate 70 fixed at a predetermined interval to the back surface of the first guide portion 46*a*. The second slide rail 47*b* is fixed to a flat surface formed by partially cutting away the outer peripheral surface portion of the guide shaft 48. The configuration of the second slide rail 47*b* is substantially the same as that of the first slide rail 47*a*. The guide rollers 44 of the second support bracket 37*b* roll on the second slide rail 47*b*, whereby the second divisional container 31*b* is supported by the second slide rail 47*b* so as to be capable of reciprocating.

An intermediate portion of the support plate 70 is fixed to the back surface of the first guide portion 46*a*, and both end portions thereof protrude in a direction perpendicular to the back surface (back surface side). A swinging motor 50 is fixed to a protruding wall 70*a* at one end, and the guide shaft 48 is rotatably supported by a protruding wall 70*b* at the other end. One end portion of a link 51 is fixed to the rotation shaft of the swinging motor 50, and a protrusion 51*a* is formed at the other end of the link 51. The protrusion 51*a* is arranged at the opening portion of a longitudinally elongated ring 52 provided at one end of the guide shaft 48. Further, when the swinging motor 50 is driven to make normal and reverse rotation, the link 51 rotates, and the longitudinally elongated ring 52 is rotated via the protrusion 51*a* to rotate the guide shaft 48. As a result, the second guide portion 46*b* swings, and the second divisional container 31*b* supported by the second guide portion 46*b* moves between the horizontal position shown in FIG. 14 and the vertical position shown in FIG. 15.

The opening at the lower end of each powder medicine accommodation part 36 can be opened and closed by a bottom plate 53. One end portion of the bottom plate 53 protrudes sidewise, and is supported at the intermediate position of the protruding portion so as to be rotatable about a pivot 53*a*. A spring 36*c* is locked between lock members 36*a*, 36*b* protruding from the upper side surface of the powder medicine accommodation part 36 and protruding from a predetermined position of the bottom plate 53, respectively. As a result, the bottom plate 53 closes the opening at the lower end of the powder medicine accommodation part 36 due to the urging force of the spring 36*c*. When, in this closed state, powder medicine is dropped from the V-shaped dispenser box 30, the dropped powder medicine is uniformly accommodated in each powder medicine accommodation part 36. Further, the divisional container 31 is moved, and, at the point in time when the powder medicine accommodation part 36 concerned comes to be situated at a position above a hopper 54 described below, a portion (pressure receiving portion 53*b*) further protruding from the pivot 53*a* is pressurized by a solenoid or the like (not shown), and the bottom plate 53 is rotated about the pivot 53*a* against the urging force of the spring 36*c*, whereby the opening at the lower end of the powder medicine accommodation part 36 is opened, and the powder medicine accommodated therein is supplied to the dispensing/packaging unit 4 through the hopper 54.

(3 Dispensing/Packaging Unit)

In the dispensing/packaging unit 4, tablets or powder medicine supplied from the tablet feed unit 2 or the powder medicine feed unit 3 through the hopper 54 is packed in a packing paper sheet P for each package. The packing paper sheet P is wound around a roll 4*a*, and a feeding direction thereof is eventually converted to an obliquely downward one via a plurality of rollers 4*b*. The lower end portion of the hopper 54 is situated in a space formed by being bent into a V-shape by the triangular plate. The opening portion of the packing paper sheet P to which medicine has been supplied through the hopper 54 is sealed by a sealing portion 55 on the further downstream side to pack the medicine into one package.

It is also possible to rewind the packing paper sheet P wound around the roll 4*a* in a state in which the packing paper sheet P is folded into two in the longitudinal direction.

As shown in FIGS. 2B and 2C, the sealing portion 55 includes a stationary sealing member 110, and a movable sealing member 111 rotating about a pivot 111*a* and moving toward and away from the stationary sealing member 110. The position in which the movable sealing member 111 is close to the stationary sealing member 110 is a heat sealing position shown in FIG. 2B(a), and the position in which the movable sealing member 111 is opened and moved away therefrom is an operating position shown in FIG. 2B(b) for passing the packing paper sheet.

In each of the sealing members 110, 111, a heater roller 113 is rotatably supported by a roller frame 112. Each roller frame 112 is provided with a bearing portion 114, by means of which a shaft portion 113*a* of the heater roller 113 is rotatably supported. The heater roller 113 has a substantially I-shaped sectional configuration, and disc-like first heat portions 115 situated at both ends thereof roll on both side portions of the packing paper sheet to thereby effect sealing. Further, each time a second heat portion 116 connecting the first heat portions 115 makes half rotation, the packing paper sheet is sealed, and is longitudinally divided at predetermined intervals. A main gear 117 and a sub gear 118 are integrated on a shaft portion 113*a* of the heater roller 113. The sub gear 118 has gears on a cylindrical surface and a conical surface at the forward end thereof. In the heat sealing position, the main gears 117 and the sub gears 118 are in mesh with each other, and in the operating position, the conical surface gears of the sub gears 118 are in mesh with each other. That is, in the opening/closing operation of the seal members 110, 111, one of the gears 117 and 118 are always in mesh with each other. Further, power is transmitted from a motor (not shown) to the main gear 117 of the stationary sealing member 110. As a result, when the motor is driven to rotate the main gear 117 of the stationary sealing member 110 to thereby rotate the heater roller 113, the heater roller 113 of the movable sealing member 111 also rotates in synchronism therewith. Thus, it is possible to always maintain a fixed positional relationship between the two members 110, 111, making it possible to seal the same position of the packing paper sheet reliably and synchronously owing to the second heat portions 116.

A protective cover 119 for preventing burning is rotatably mounted to the movable sealing member 111. As shown in FIG. 2D, the protecting cover 119 is obtained by molding a synthetic resin material superior in heat resistance (e.g., ABS heat resistant resin) into a plate equipped with a curved surface extending along the heater roller 113. A cutout portion 119*a* is formed in the side edge portion of the protective cover 119, and there is provided a roller guide portion 119*b* protruding from the outer surface side so as to be continuous with the cutout portion 119*a*. The protective cover 119 is rotatable about a pivot 119*c*, and is urged by a spring (not shown) so as to be situated around the heater roller 113.

The stationary sealing member 110 is provided with an abutment roller 120 for pressurizing the protective cover 119 to bring the protective cover 119 into and out of contact with the heater roller 113. As shown in FIG. 2C(b), when bringing the movable sealing member 111 close to the stationary sealing portion, the abutment roller 120 pressurizes the roller guide portion 119*b* and rolls to the inner surface of the protective cover 119 through the cutout portion 119*a*, thereby rotating it to a position spaced apart from the heater roller 113 against the urging force of the spring in the heat seal position as shown in FIG. 2C(a).

A power supply canceling plate 121 is integrated with a roller frame 112 of the movable sealing member 111. Further, as shown in FIG. 2E(a), the roller frame 112 of the stationary sealing member 110 is provided with a limit switch 122 that is turned on/off by the power supply canceling plate 121. As a result, the movable sealing member 111 rotates away from the stationary sealing member 110, and, as shown in FIG. 2E(b), the limit switch 122 is turned off before the operating position shown in FIG. 2E(c) is established, stopping the electricity supply to the motor. As a result, the rotation of the heater roller 113 is automatically stopped through the opening operation of the movable sealing member 111.

(4 Apparatus Main Body)

The apparatus main body 1 is provided with a movement route in which the tablet accommodation member 5 reciprocates. The movement route is formed on a frame member 56 constituting the upper outer surface of the apparatus main body 1.

As shown in FIG. 3, a rectangular opening is formed in the upper surface of the frame member 56, making it possible to accommodate tablets in the tablet accommodation parts 7 of the tablet accommodation member 5 through manual dispensing. Further, a guide groove 57 is formed in an inner side surface of the frame member 56. The guide groove 57 continuously extends from a linear portion 57*a* formed in the upper portion of the inner side surface of the frame member 56 to an arcuate portion 57*b* formed in the inner surface at one end thereof. Under the linear portion 57*a* of the guide groove 57, there is mounted a support panel 58. The support panel 58 is positioned so as to extend along the bottom surface of the tablet accommodation member 5 sliding on the upper surface thereof, and an edge portion at one end thereof is formed in a step-like configuration to open each bottom plate 13. Further, in the interior of one end portion of the frame member 56, there are formed an arcuate outer peripheral wall 59 and a cylindrical inner peripheral wall 60 corresponding to the arcuate portion 57*b*. The outer peripheral wall 59 and the inner peripheral wall 60 form an arcuate passage 61 for guiding the region where the tablet accommodation member 5 undergoes a change in direction. Further, a support roller 20 provided on the holding member 6 rolls in the guide groove 57 of the frame member 56, whereby the tablet accommodation member 5 moves horizontally on the support panel 58, and is then changed in direction vertically downwards before being changed in direction back to the horizontal direction (the direction opposite to the above-mentioned horizontal direction). A hopper 54 is arranged between the support panel 58 and the arcuate passage 61 to recover the tablets supplied from the tablet accommodation member 5 and to transfer them to the dispensing/packaging unit 4. The support panel 58 is supported by the frame member 56, and is longitudinally slidable. Thus, it is possible to remove the support panel 58 at the time of maintenance, cleaning, or the like of the hopper 54.

Further, as shown in FIGS. 16, the apparatus main body 1 is provided with a first cover 62 covering the tablet feed unit 2. The first cover 62 has a pocket portion 62*a* in which prescription slips are to be put in the open state. Further, the first cover 62 can be detached from the opening/closing position and attached to a lower portion of the front surface of the apparatus main body 1. The lower side of the V-shaped dispenser box 30 is covered with a second cover 63. By opening the second cover 63, the handling of the divisional container etc. arranged below the V-shaped dispenser box 30 is facilitated at the time of maintenance or the like. Further, an operation panel 64 is provided by the side of the V-shaped dispenser box 30. Information as set forth on a prescription slip is input at the operation panel 64, making it possible to start the dispensing/packaging processing described below. Reference numeral 65 indicates a hose extending from a built-in cleaner for cleaning, which can be put in and out of the apparatus main body 1.

(Operation)

Next, the operation of the medicine dispensing/packaging apparatus constructed as described above will be illustrated.

According to the prescription as set forth on the prescription slip, the pharmacist accommodates tablets in an amount corresponding to one package in each tablet accommodation part 7 of the tablet feed unit 2. In the case of powder medicine, the position of the partition triangular plate 35 is adjusted in the V-shaped dispenser box 30 of the powder medicine feed unit 3 according to the number of packages to be obtained, the powder medicine is accommodated and made even, the divisional container 31 is moved to a position below the V-shaped dispenser box 30, and, by opening the opening/closing plate 34, the powder medicine accommodated in the V-shaped dispenser box 30 is equally divided into the powder medicine accommodation parts 36.

The pharmacist inputs the content of the prescription slip at the operation panel 64, whereby the medicine as prescribed starts to be supplied from the tablet feed unit 2 or the powder medicine feed unit 3.

That is, in the tablet feed unit 2, the table accommodation member 5 starts to move in the horizontal direction by driving a feed motor 27. Then, the bottom plates 13, having ceased to be supported on the bottom side by the support panel 58, are successively opened, and the accommodated (manually dispensed) tablets fall into the hopper 54. The feed amount of the tablet accommodation member 5 is set to a value allowing conveyance one pitch at a time through detection by a sensor of the detection holes 29*a* formed in the detection disc 29. Further, the edge portion of the opening formed in the support panel 58 is shaped in the form of three steps in conformity with the three tablet dispenser boxes 8 provided side by side. As a result, it is possible to move the tablet accommodation parts 7 one by one to a position above the hopper 54 and to open the bottom plates 13 thereof. The tablet accommodation member 5 is carried in the horizontal direction, and is then changed in direction vertically downwards by moving through the arcuate passage 61. Then, at the point in time when the tablet accommodation member 5 has attained the arcuate state as shown in FIGS. 6, the tablets are paid out from the last tablet accommodation part 7.

In this way, in the tablet feed unit 2, the tablet accommodation member 5 is converted from the horizontal direction to the vertical direction, so the dead space is effectively utilized, thereby providing a compact construction.

In the tablet feed unit 2, when, for example, cleaning the tablet accommodation member 5, it can be detached from the holding member 6. That is, it is only necessary to detach each lock portion 11 of the tablet accommodation member 5 from each lock reception portion 22 of the holding member 6. Thus, it is possible for the pinion gear 24 and the first rack gear 23 to be kept in mesh with each other, making it possible to maintain a desired assembly precision. The detached tablet accommodation member 5 can be easily cleaned through washing in water or the like. Further, the holding member 6 and the support panel 58 can also be detached as needed. That is, the detachment can be easily effected solely by detaching one end surface of the frame member 56 and sliding the holding member 6 and the support panel 58. As a result, the holding member 6 and the support panel 58 can also be easily cleaned. Further, by removing those components, a sufficient operation space is formed within the frame member 56, so the hopper 54 etc. can also be easily cleaned.

In the powder medicine feed unit 3, the divisional container 31 (the first divisional container 31*a* and the second divisional container 31*b*) in which powder medicine is uniformly divided is moved (to the left in FIG. 12) via the pinion gear 101 and the rack gears 38*a*, 38*b* by driving the feed motor 100. The first detection portion 40*a* is detected by the first detection sensor 41*a*, whereby the divisional container 31 is set at the initial position (see FIG. 17(*a*)). Inside the V-shaped dispenser box 30, the partition triangular plate 35 is slid to a position corresponding to a predetermined number of (here, thirteen) packages, and powder medicine is accommodated and made even. The divisional container 31 is moved to the opposite side (to the right from the position of FIG. 17(*a*)). At this time, the LED 80 is set to "red blinking, " and, after a while, the user is informed to the effect that it is possible to drop powder medicine from the V-shaped dispenser box 30 into the divisional container 31. Then, one end portion of the divisional container 31 is positioned below the partition triangular plate 35 (see FIG. 17(*b*)). When the positioning of the divisional container 31 is completed, the LED 80 is set to "blue lighting" to inform to the effect that powder medicine can be dropped from the V-shaped dispenser box 30. Subsequently, the opening/closing plate 34 is opened, and the powder medicine in the V-shaped dispenser box 30 is dropped, equally dividing the medicine into the powder medicine accommodation parts 36 of the divisional container 31. When the powder medicine has been divided in the divisional container 31, the LED 80 is set to "red lighting," and a warning is issued to the effect that no powder medicine can be dropped from the V-shaped dispenser box 30 into the divisional container 31. After that, the divisional container 31 is moved pitch by pitch, positioning is successively effected on the powder medicine accommodation parts 36 over the hopper 54, and their bottom plates 13 are successively opened, whereby the powder medicine accommodated is dropped.

When all the powder medicine accommodated in the powder medicine accommodation parts 36 of the second divisional container 31*b* has been supplied, the supply of the powder medicine from the powder medicine accommodation parts 36 of the first divisional container 31*a* is started. Then, based on the number of pulses of the voltage applied to the feed motor 100, at the point in time when the dispensing/packaging of twelve packages (four packages in the first divisional container 31*a*) has been completed (first movement terminal position), no further movement of the divisional container 31 is possible, so the driving of the feed motor 100 is stopped. Subsequently, the swinging motor 50 is driven, and the second divisional container 31*b* is swung from the horizontal position shown in FIG. 14 to the vertical position shown in FIG. 15 (see FIG. 17(*c*)). As a result, it is possible to further move the first divisional container 31*a* in the horizontal direction. Further, based on the number of pulses of the voltage applied to the feed motor 100, at the point in time when the last powder medicine accommodation part 36 comes to be situated over the hopper 54, it is possible to supply all the twenty-one packages of powder medicine. After that, the divisional container 31 is moved by an amount corresponding to one powder medicine accommodation part 36 (second movement terminal position; see FIG. 18(*a*)), and the powder medicine accommodation part 36 for the twenty-first package is situated directly below the suction duct 66.

In this way, in the powder medicine feed unit 3, the first divisional container is moved to a space formed by swinging the second divisional container 31*b*. Thus, an increase in the space in the moving direction is suppressed, making it possible to provide a compact construction. The second divisional container 31*b* moves not only upwardly but also sidewise, and further, the powder medicine accommodation parts 36 are directed sidewise, so there is no fear of residual powder medicine in the second divisional container 31*b* falling into the first divisional container 31*a* situated below to be allowed to be mixed together to thereby cause a problem (contamination).

When the supply of powder medicine from the powder medicine accommodation parts 36 of the divisional container 31 has been completed, the feed motor 100 is caused to make reverse rotation, whereby the divisional container 31 is moved in the opposite direction (to the left in FIG. 12). When the second divisional container 31*b* has not been swung, it is directly moved to the initial position where the first detection portion 40*a* is detected by the first detection sensor 41*a*, and is kept on standby. When the second divisional container 31*b* has been swung, the first divisional container 31*a* is moved to the left from the position shown in FIG. 18(*a*). When the first divisional container 31*a* is moved to the first movement terminal position, the first divisional container 31*a* is stopped temporarily, and the swinging motor 50 is caused to make reverse rotation, whereby the second divisional container 31*b* is swung from the vertical position to the horizontal position (see FIG. 18(*b*)). As a result, the connecting portion 39*b* of the second divisional container 31*b* is connected to the connecting portion 39*a* of the first divisional container 31*a* to thereby integrate the two divisional containers 31*a*, 31*b* with each other, so movement to the initial position is started again as in the case described above. When restoring the divisional containers 31*a*, 31*b* to the initial position, the cleaner (not shown) is driven, and since each powder medicine accommodation part 36 is situated below the suction duct 66, any residual powder medicine is removed.

As described above, in the case in which the second divisional container 31*b* is swung to the vertical position and kept on standby, the second divisional container 31*b* is restored to the former horizontal position after the completion of the supply of the powder medicine. At this time, there may occur a case in which the connecting portions cannot be connected to each other properly. In this case, an attempt to move the divisional container 31 to the initial position results in exclusively the first divisional container 31*a* being moved (see FIG. 18(*c*)). Thus, if the first divisional container 31*a* is moved toward the initial position, it is determined that the divisional container is in an unconnected state if the state in which the third detection portion 40*c* has been detected by the second detection sensor 41*b* persists, and the feed motor 100 is stopped. Then, the driving motor 50 is driven to swing the second divisional container 31*b* to the vertical position again, and then the motor 100 is driven to move the first divisional container 31*a* to the first movement terminal position, repeating the same operation as described above. As a result, it is possible to prevent the first divisional container 31*a* from being carried alone when the first divisional container 31*a* and the second divisional container 31*b* are not connected together. When it is determined that the divisional container is in an unconnected state even when the above series of operations have been conducted, an error alarm is issued.

Further, in the dispensing/packaging unit 4, medicine is supplied in an amount corresponding to one package at one time from the tablet feed unit 2 or the powder medicine feed unit 3, and the packaging paper sheet P is successively paid out from a roll 4*a* to seal one package at one time in the sealing portion 55. This operation is the same as in the prior art.

During the use of the above-described medicine dispensing/packaging apparatus, it can happen that the packing paper sheet is jammed in the packaging unit. In this case, the movable sealing member ill is rotated to be situated at the operating position spaced apart from the stationary sealing member 110. As shown in FIG. 2C(c), at this time, the support by the abutment roller 120 is canceled, and the protective cover 119 is rotated by the urging force of the spring so as to be situated around the heater roller 113. As a result, when setting the packing paper sheet by inserting the hand into the gap formed between the stationary sealing member 110 and the movable sealing member 111, it is possible to reliably prevent the hand from coming into contact with the heater roller 113, thereby preventing an accident such as burning. When the operation has been completed, the cover 119 can be automatically moved away from the heater roller 113 by the abutment roller 120 as shown in FIGS. 2C(b) and 2C(a) solely by bringing the movable sealing portion close to the stationary sealing portion to restore it to the former position.

DESCRIPTION OF REFERENCE NUMERALS

Figure 1A:
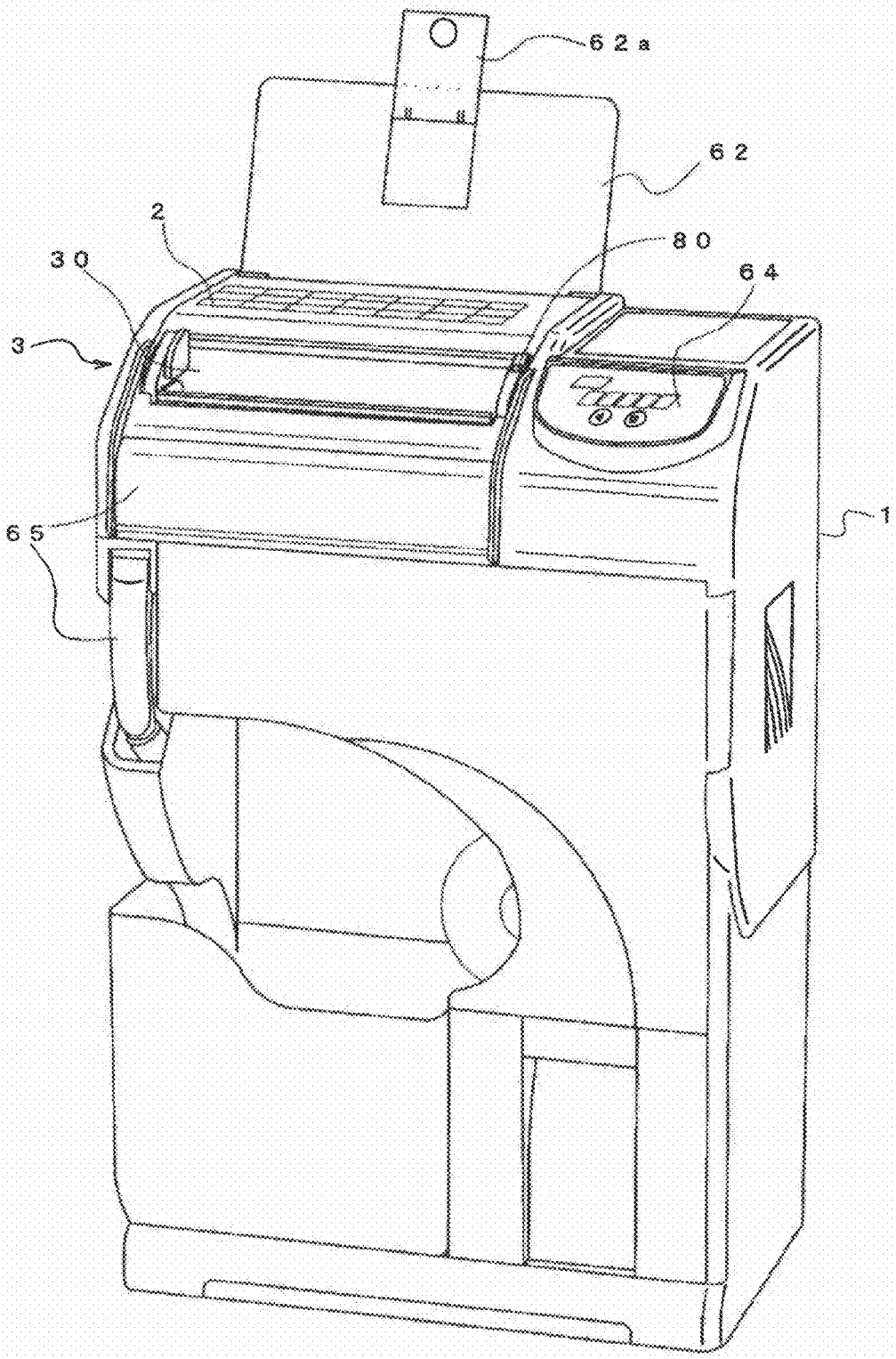
[FIG. 1A] A perspective view of a medicine dispensing/packaging apparatus according to an embodiment of the present invention.
Figure 1B:
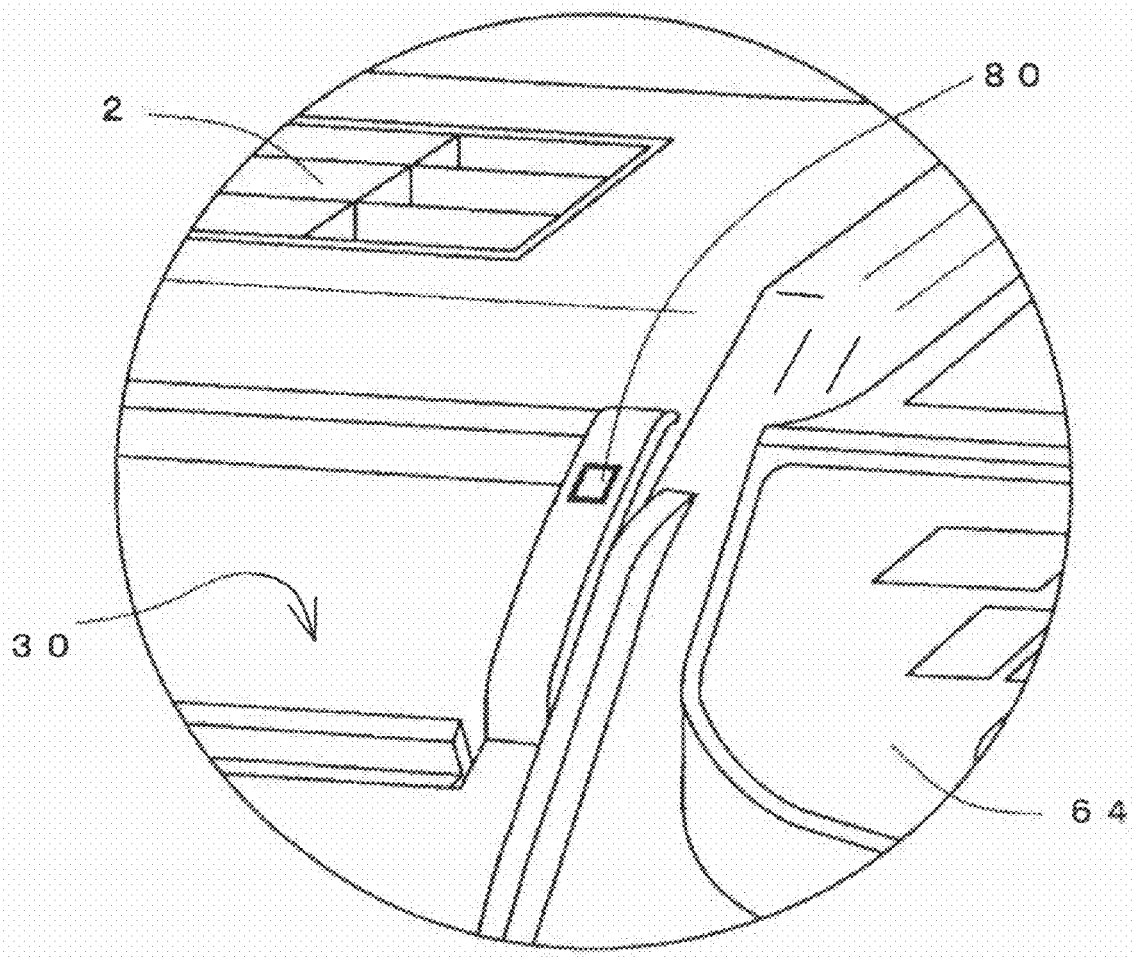
[FIG. 1B] A partial enlarged view of FIG. 1A.
Figure 2A:
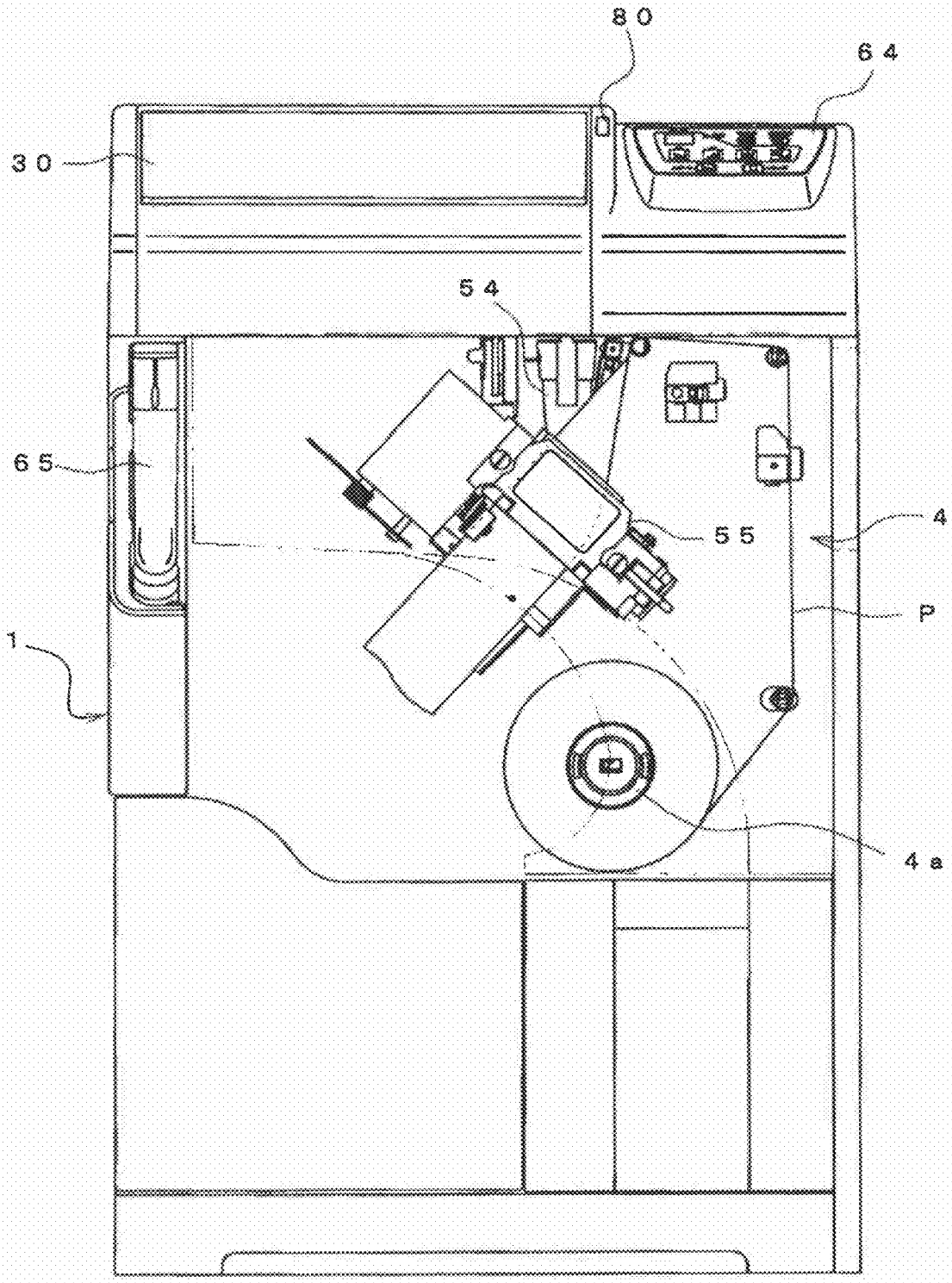
[FIG. 2A] A front view of FIG. 1.
Figure 2B:
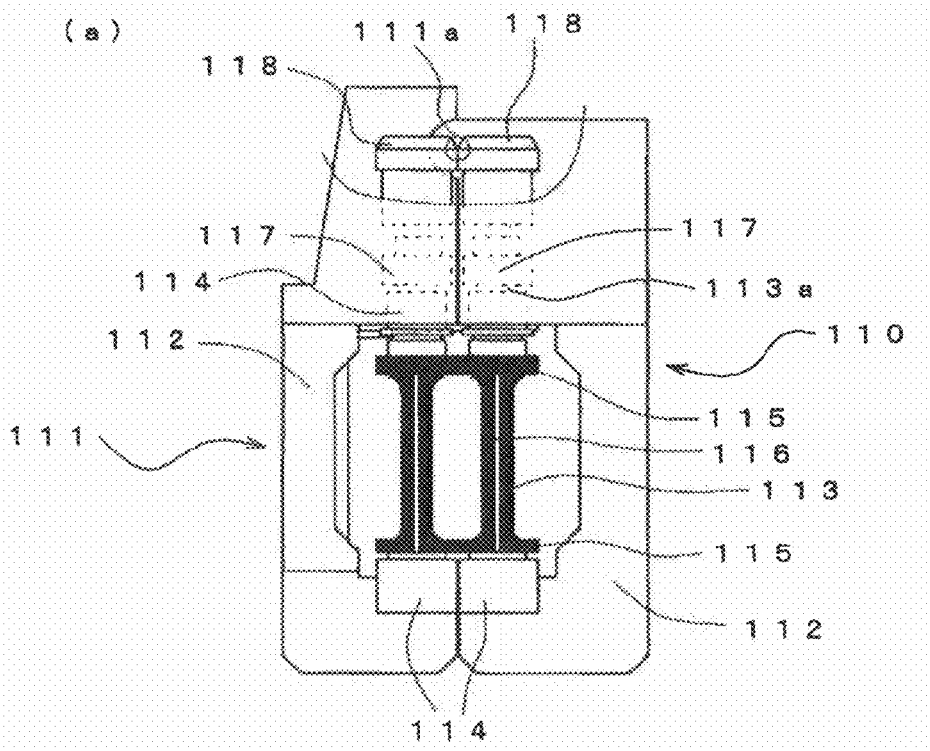
[FIG. 2B] Partially cutaway front views of a sealing portion, in which a portion (a) shows the sealing portion in the heat sealing position and a portion (b) shows the sealing portion in the operating position.
Figure 2B:
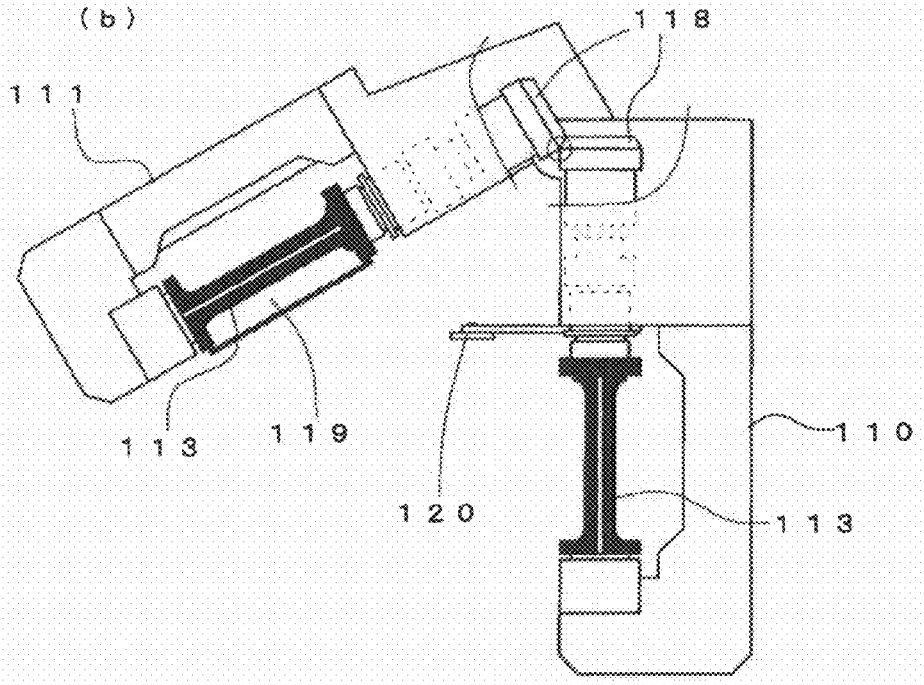
Figure 2C:
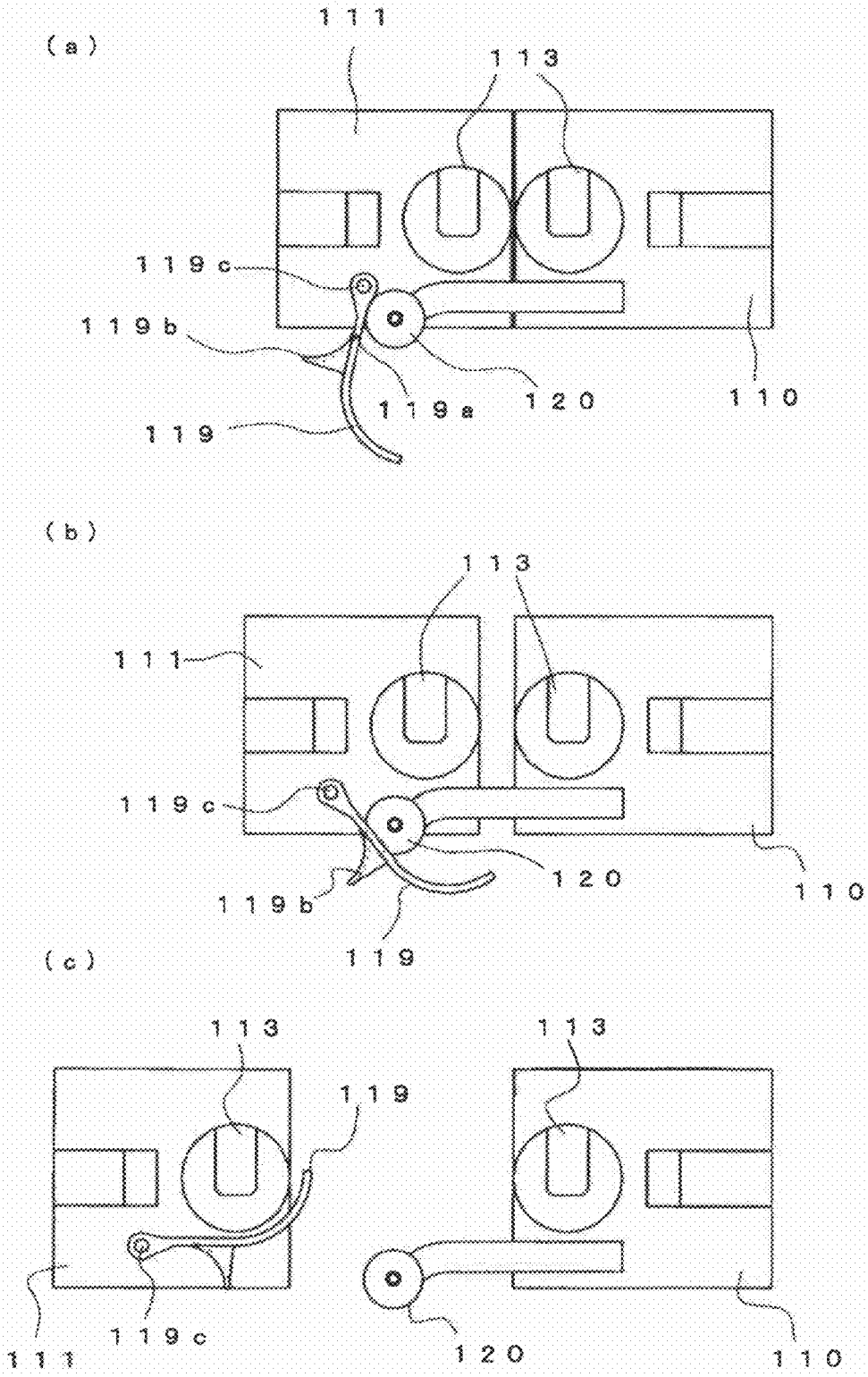
[FIG. 2C] Plan views each showing a relationship between a protective cover and an abutment roller when the sealing portion is in each position.
Figure 2D:
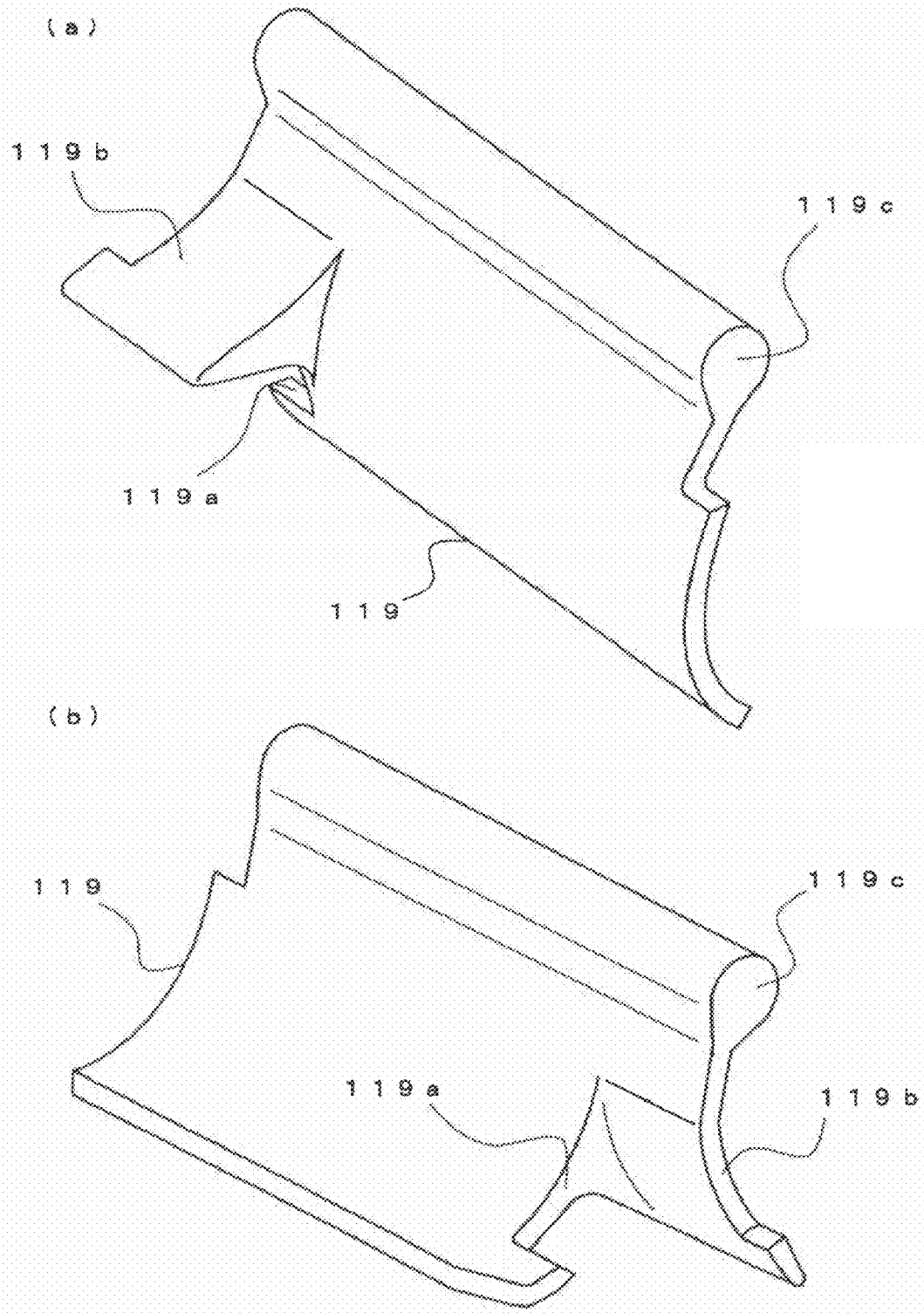
[FIG. 2D] A portion (a) is a perspective view of a protective cover, and a portion (b) is a perspective view thereof as seen in a different direction from that of the portion (a).
Figure 2E:
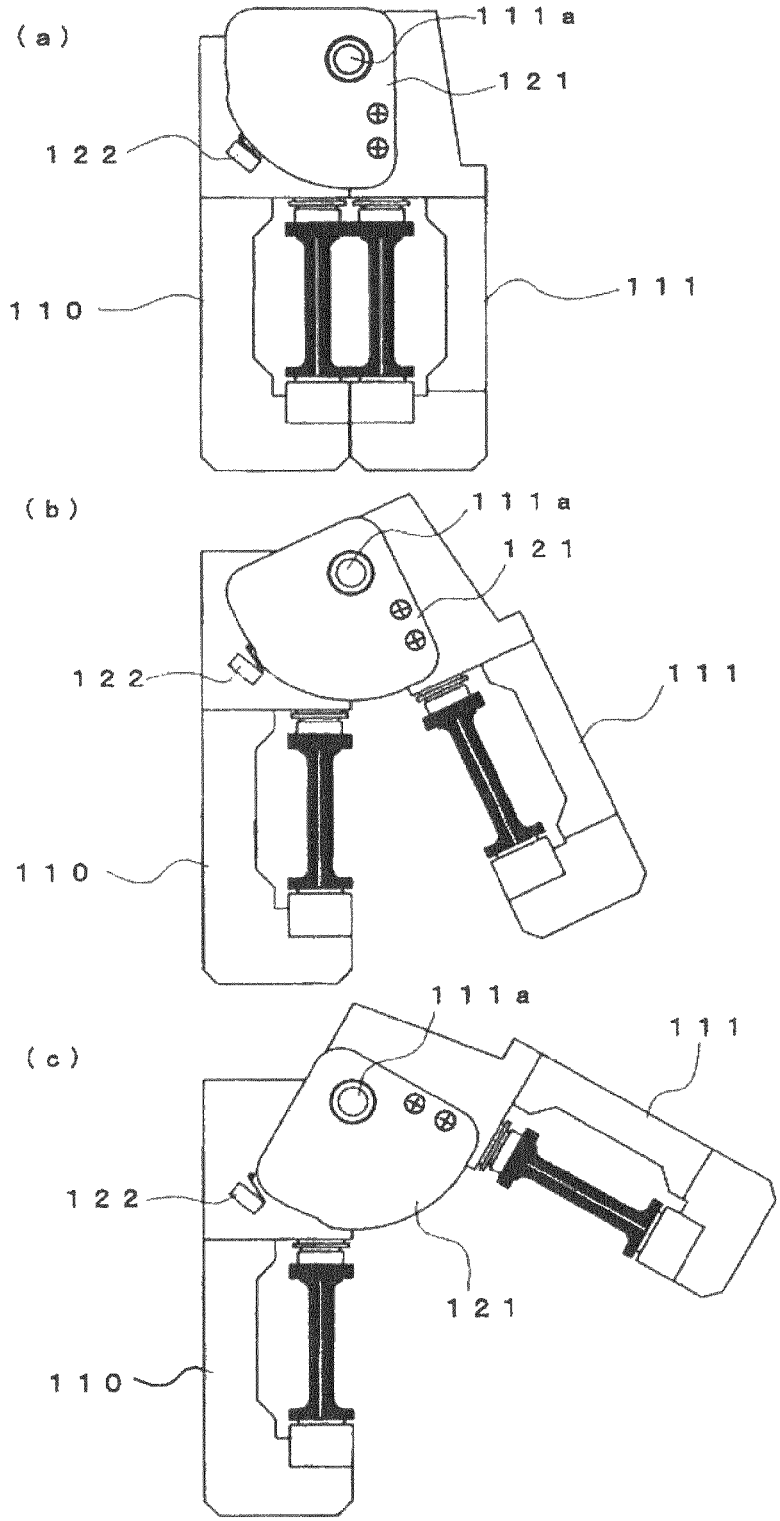
[FIG. 2E] Front views of the sealing portion, in which a portion (a) shows the sealing portion in the heat sealing position, a portion (b) shows the sealing portion in the position where the limit switch is off, and a portion (c) shows the sealing portion in the operating position.
Figure 3:
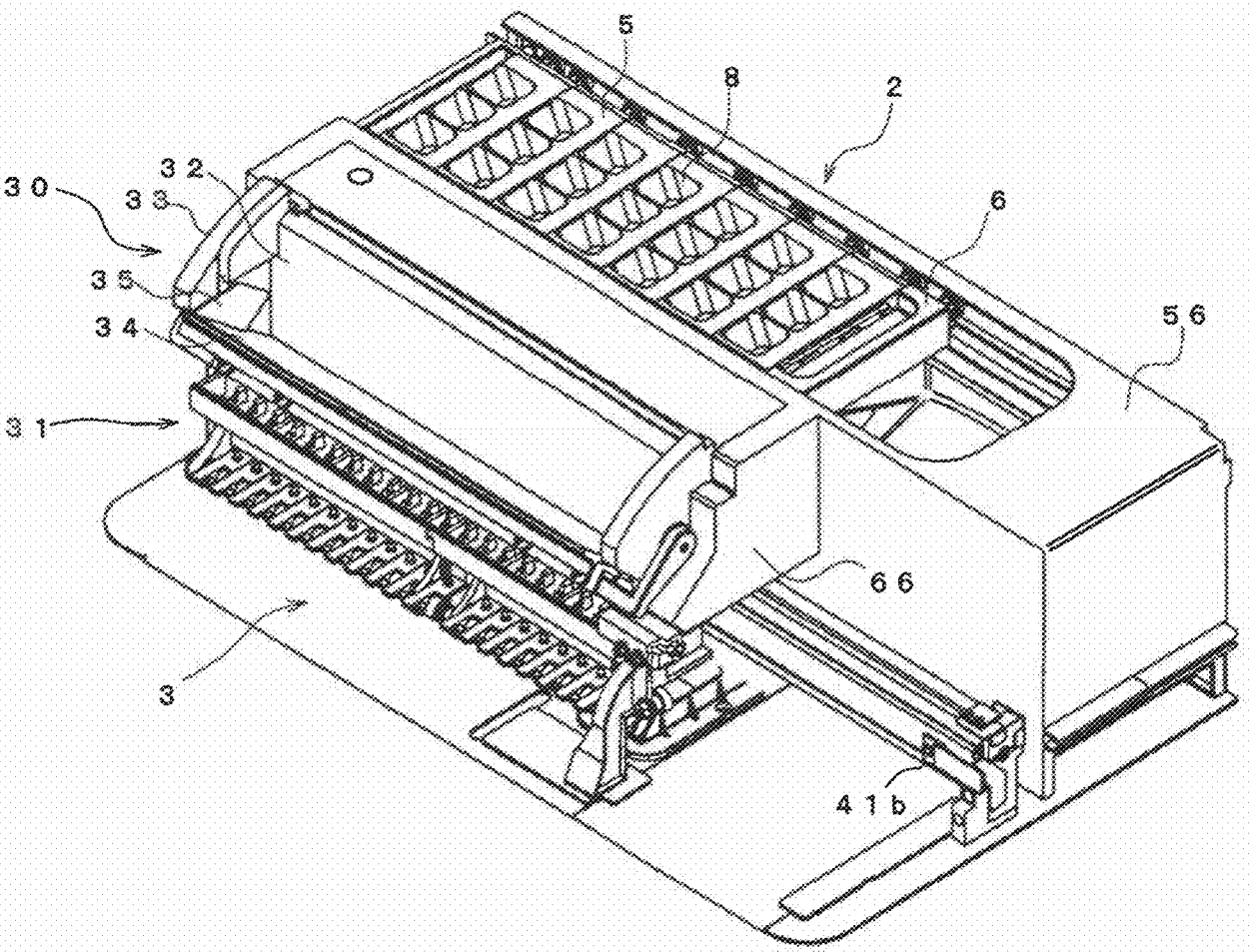
[FIG. 3] A perspective view of a tablet feed unit and a powder medicine feed unit of FIGS. 1.
Figure 4:
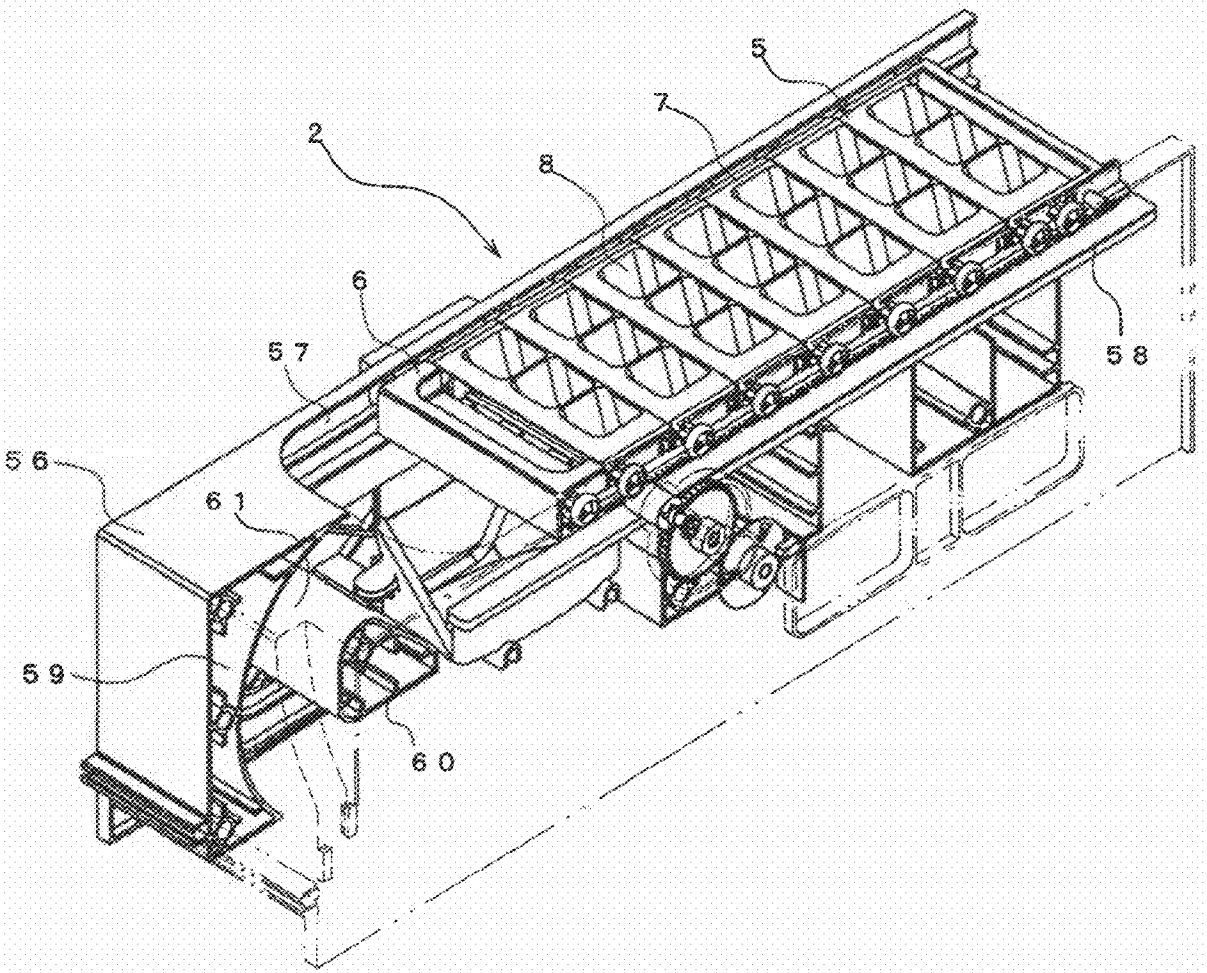
[FIG. 4] A perspective view of the tablet feed unit of FIG. 3.
Figure 5A:
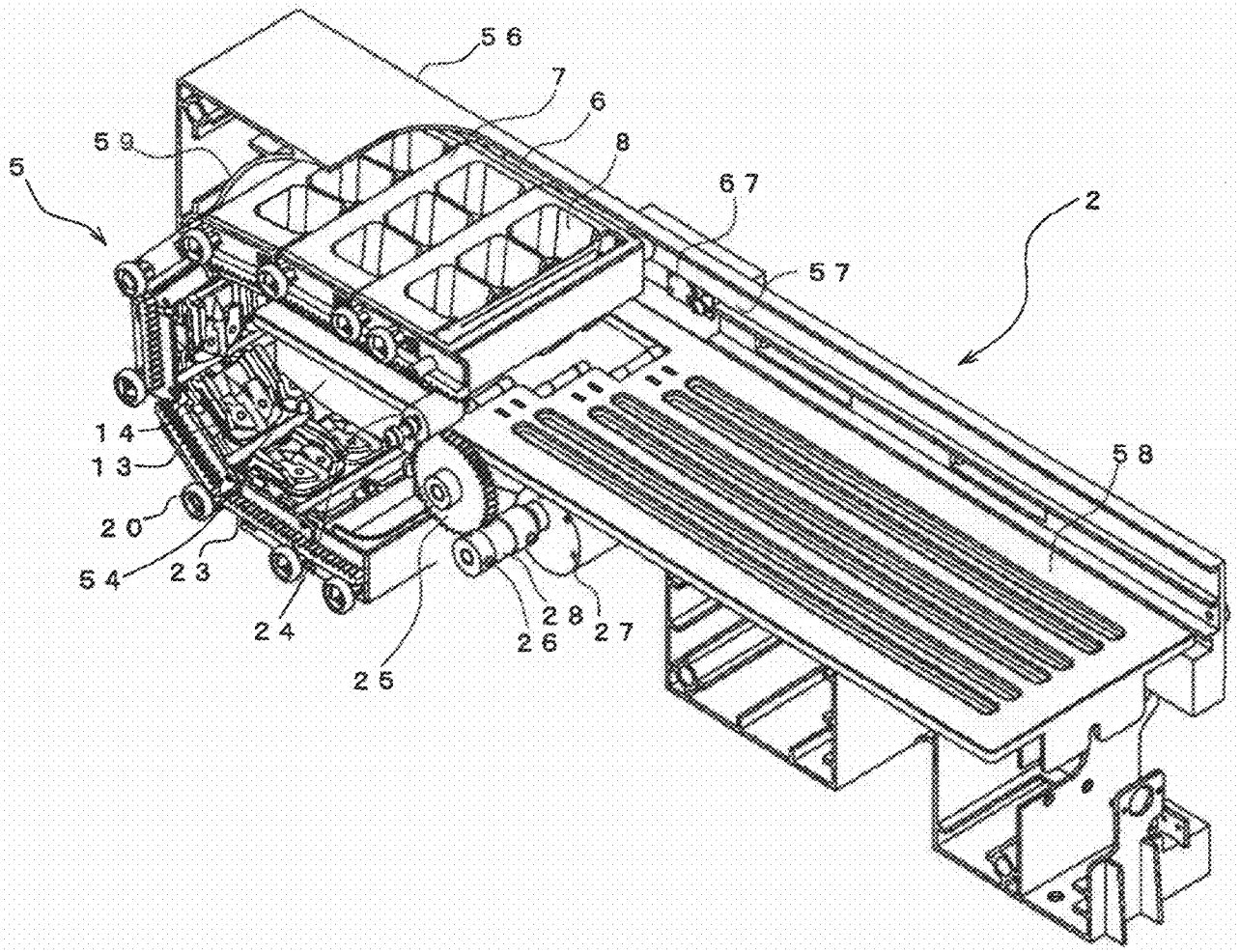
[FIG. 5A] A perspective view of the tablet feed unit of FIG. 3 as seen at a different angle.
Figure 5B:
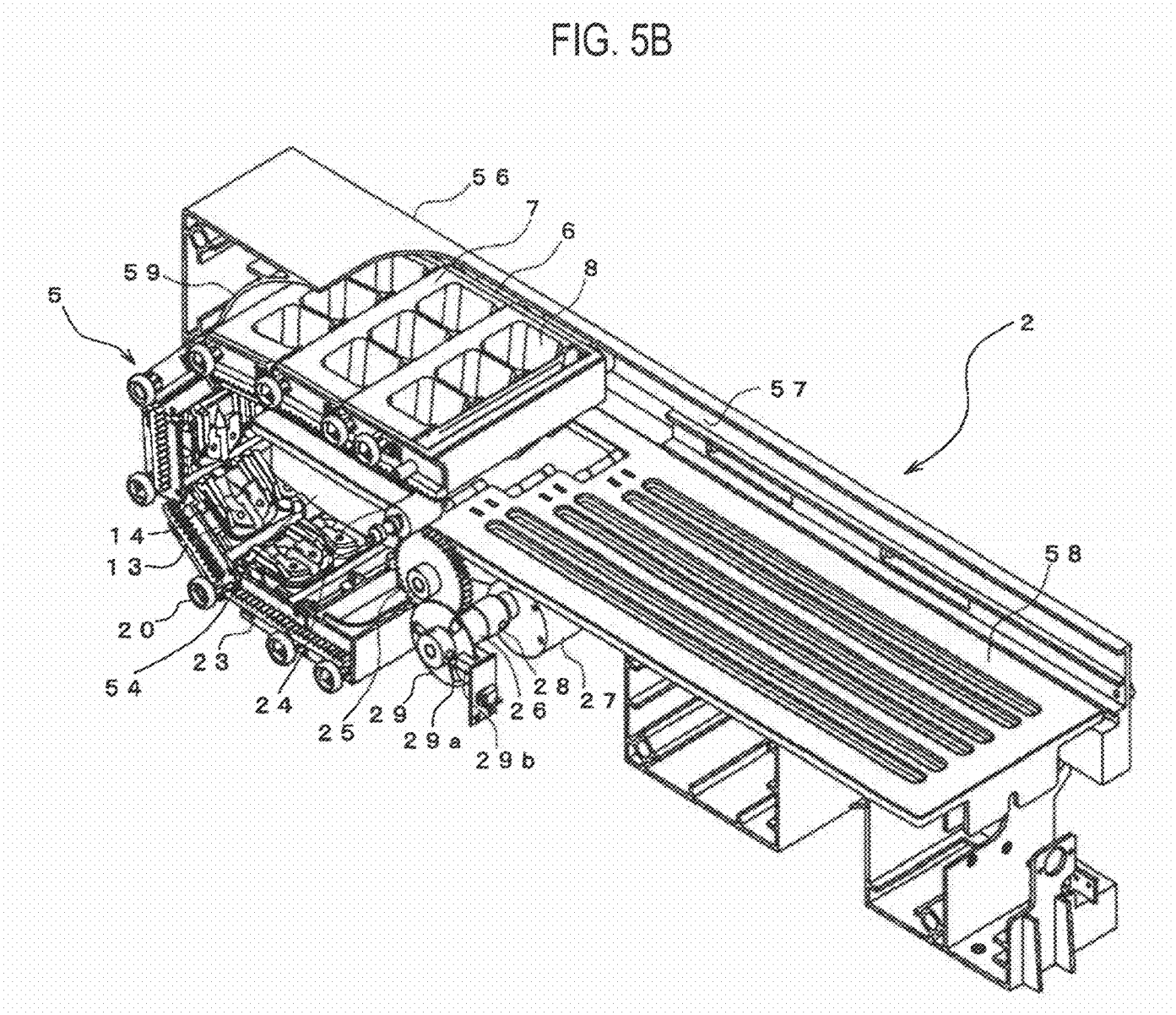
[FIG. 5B] A perspective view of another example of the tablet feed unit of FIG. 5A.
Figure 6A:
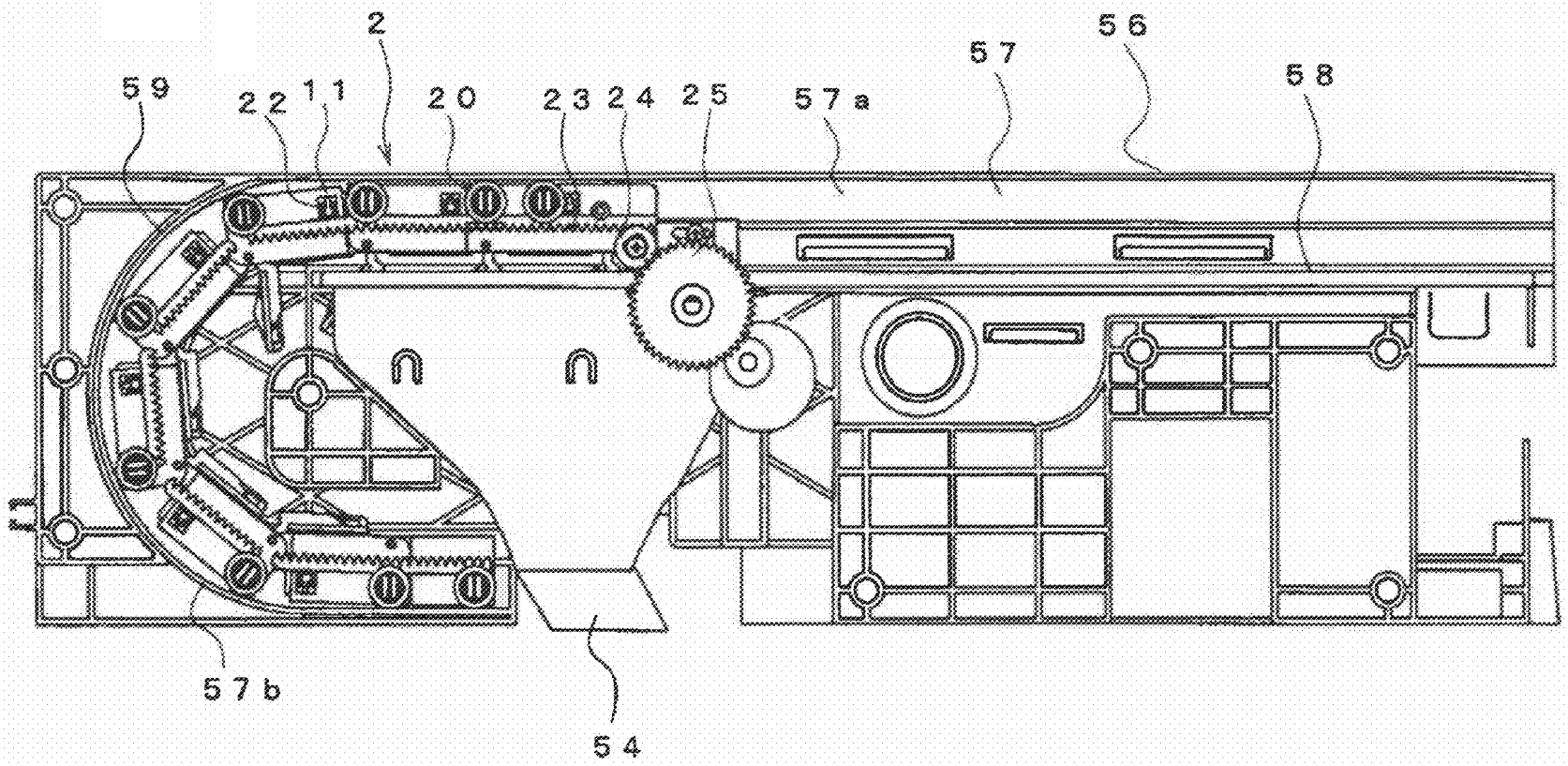
[FIG. 6A] A front view of the tablet feed unit shown in FIG. 5A.
Figure 6B:
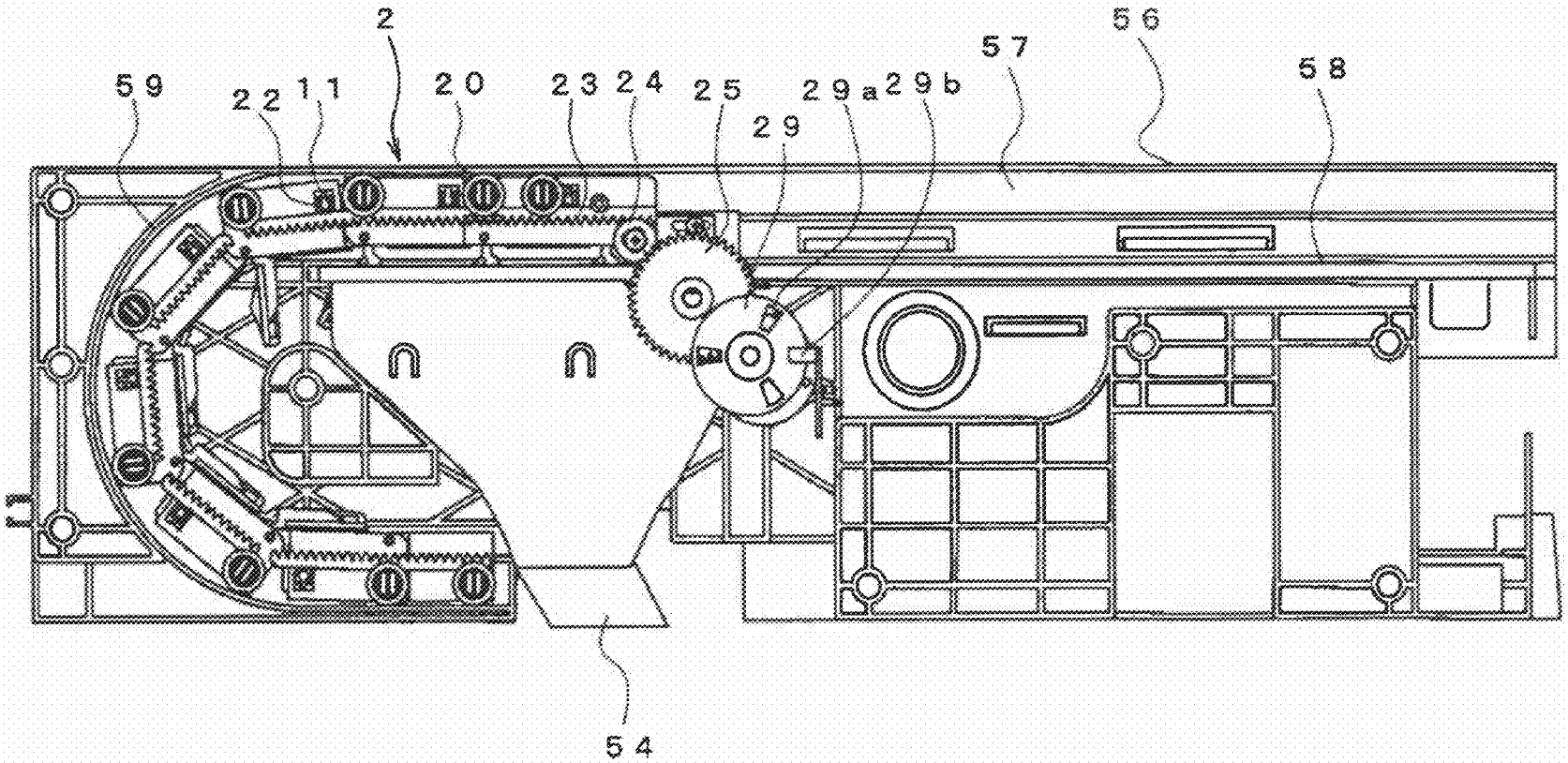
[FIG. 6B] A front view of the tablet feed unit shown in FIG. 5B.
Figure 7:
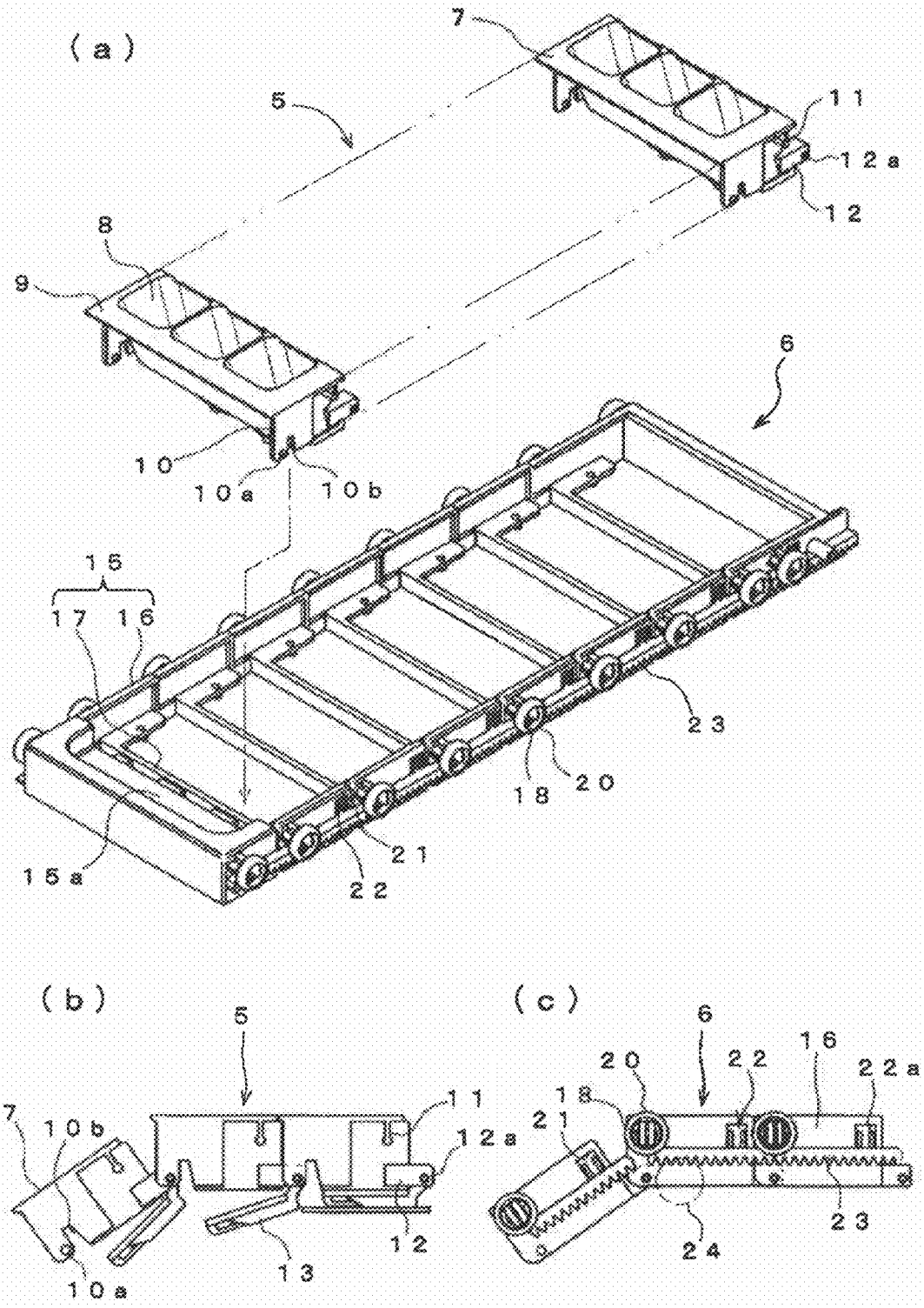
[FIG. 7] A portion (a) is an exploded perspective view of a tablet feed member of FIG. 4, a portion (b) is a partial enlarged front view of a tablet feed portion, and portion (c) is a partial enlarged view of a holding member.
Figure 8:
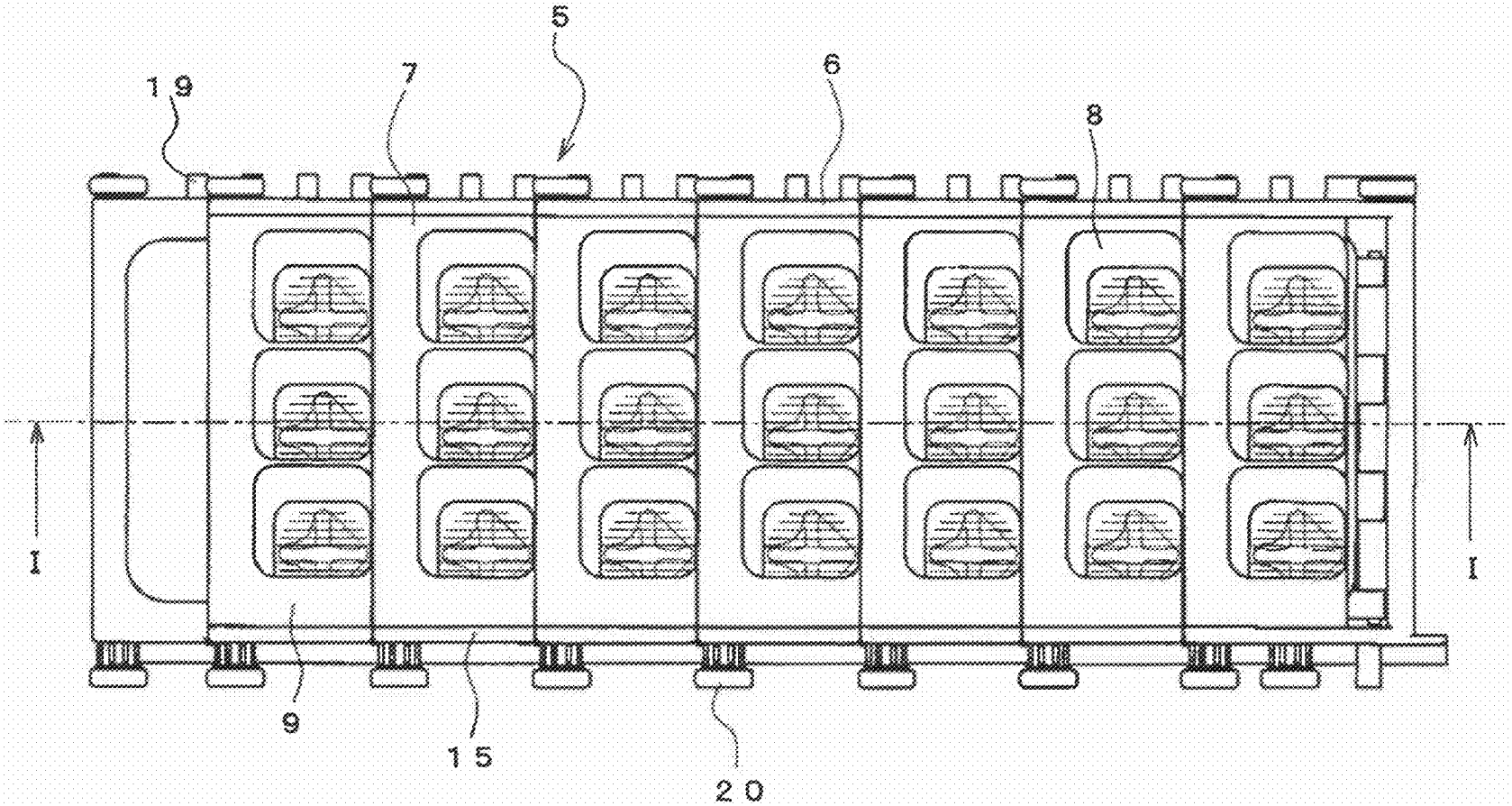
[FIG. 8] A plan view of the tablet feed member of FIG. 4.
Figure 9:
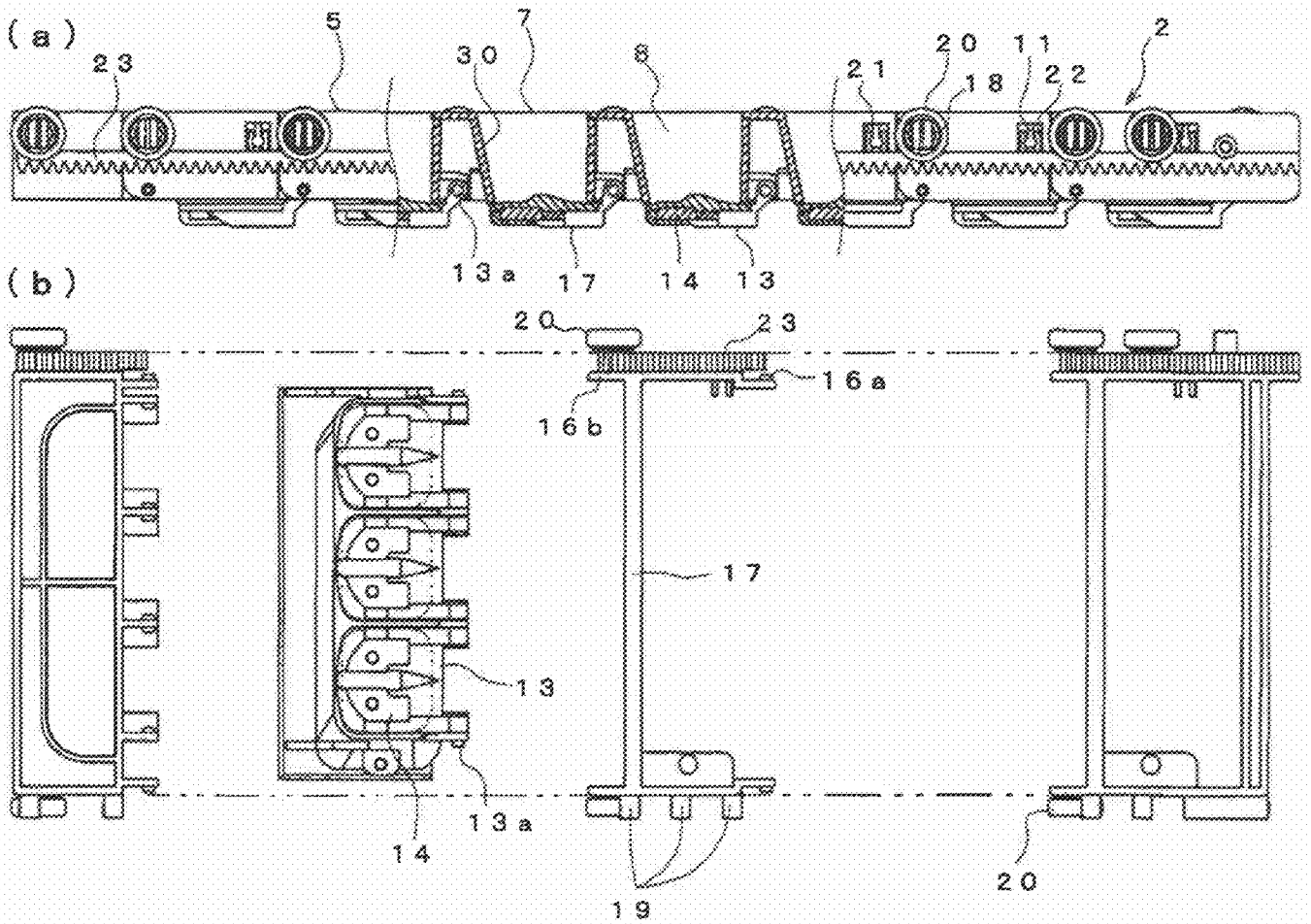
[FIG. 9] A portion (a) is a sectional view taken along the line I-I of FIG. 8, and a portion (b) is a bottom view thereof.
Figure 10:
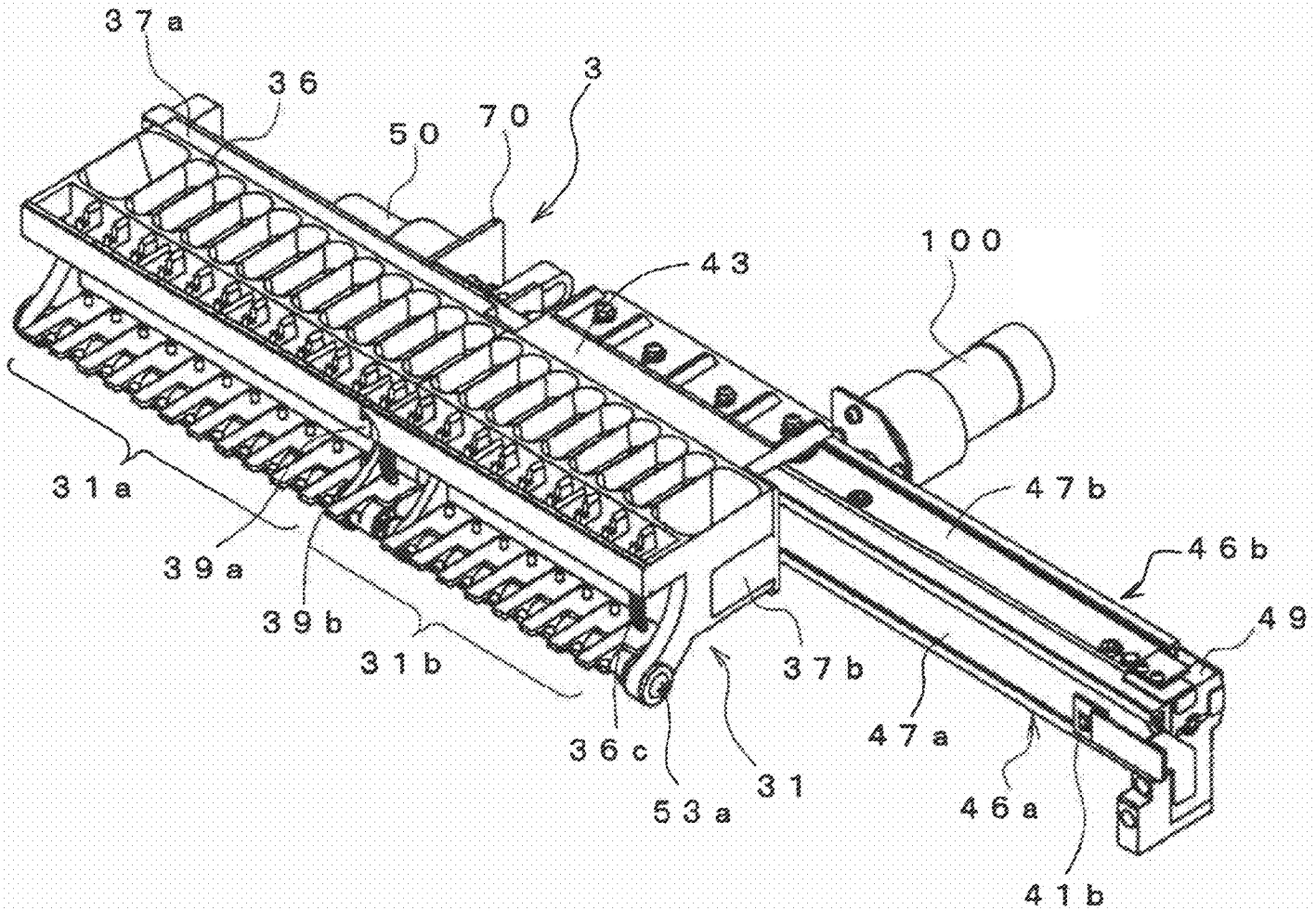
[FIG. 10] A perspective view of the powder medicine feed unit of FIG. 3.
Figure 11:
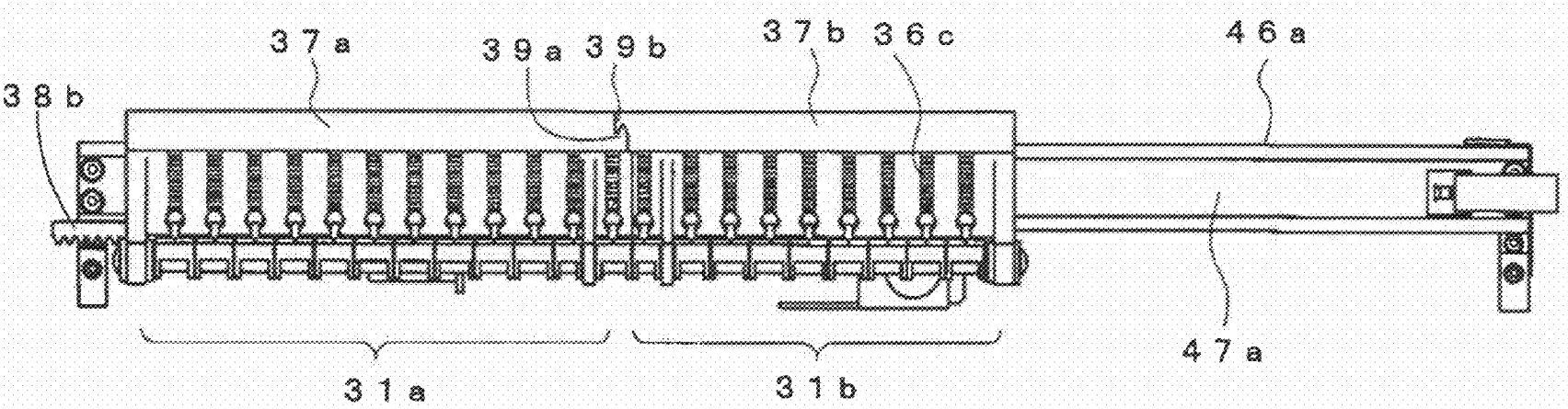
[FIG. 11] A front view of FIG. 10.
Figure 12:
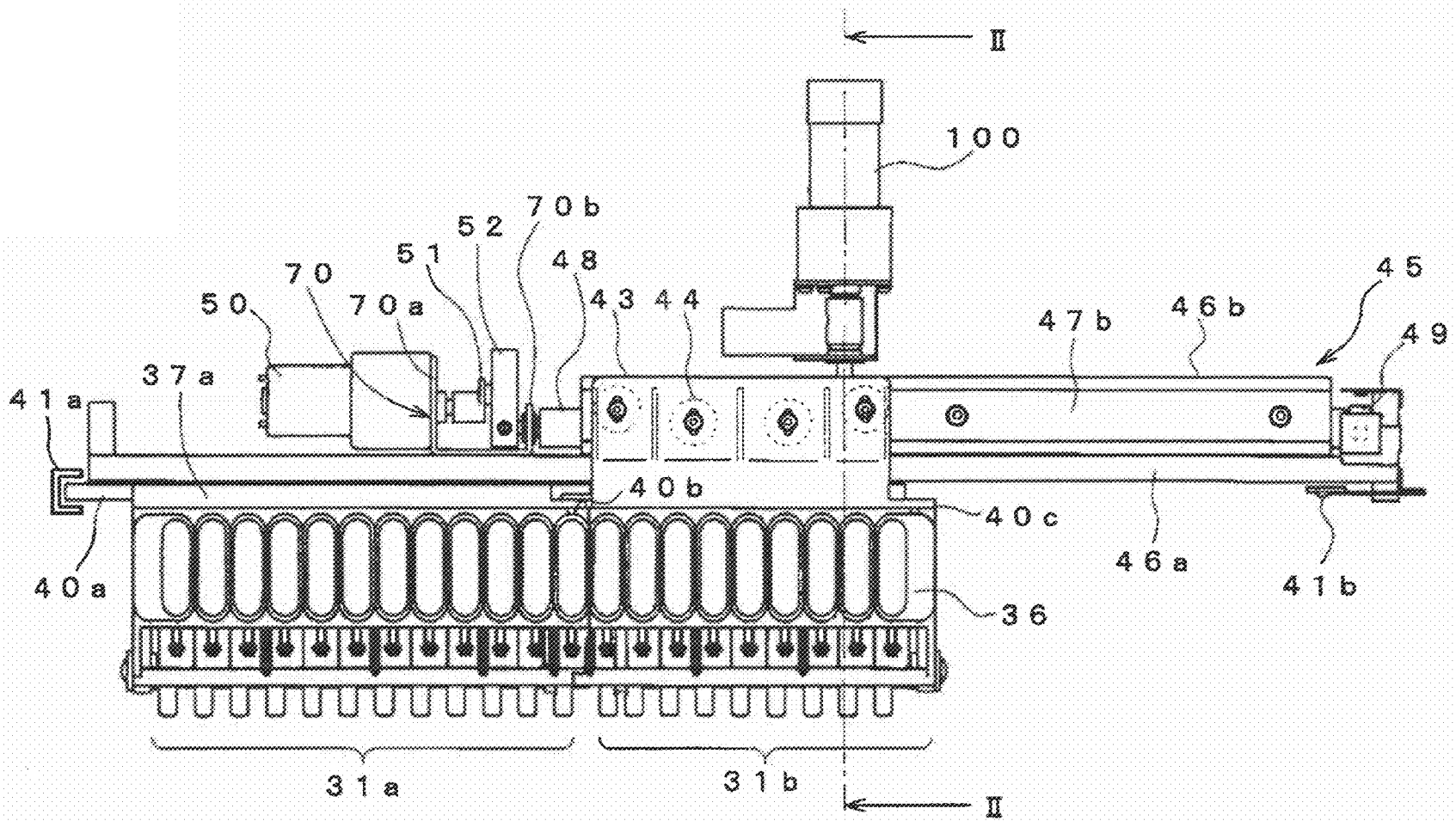
[FIG. 12] A plan view of a divisional container of FIG. 10 situated at an initial position.
Figure 13:
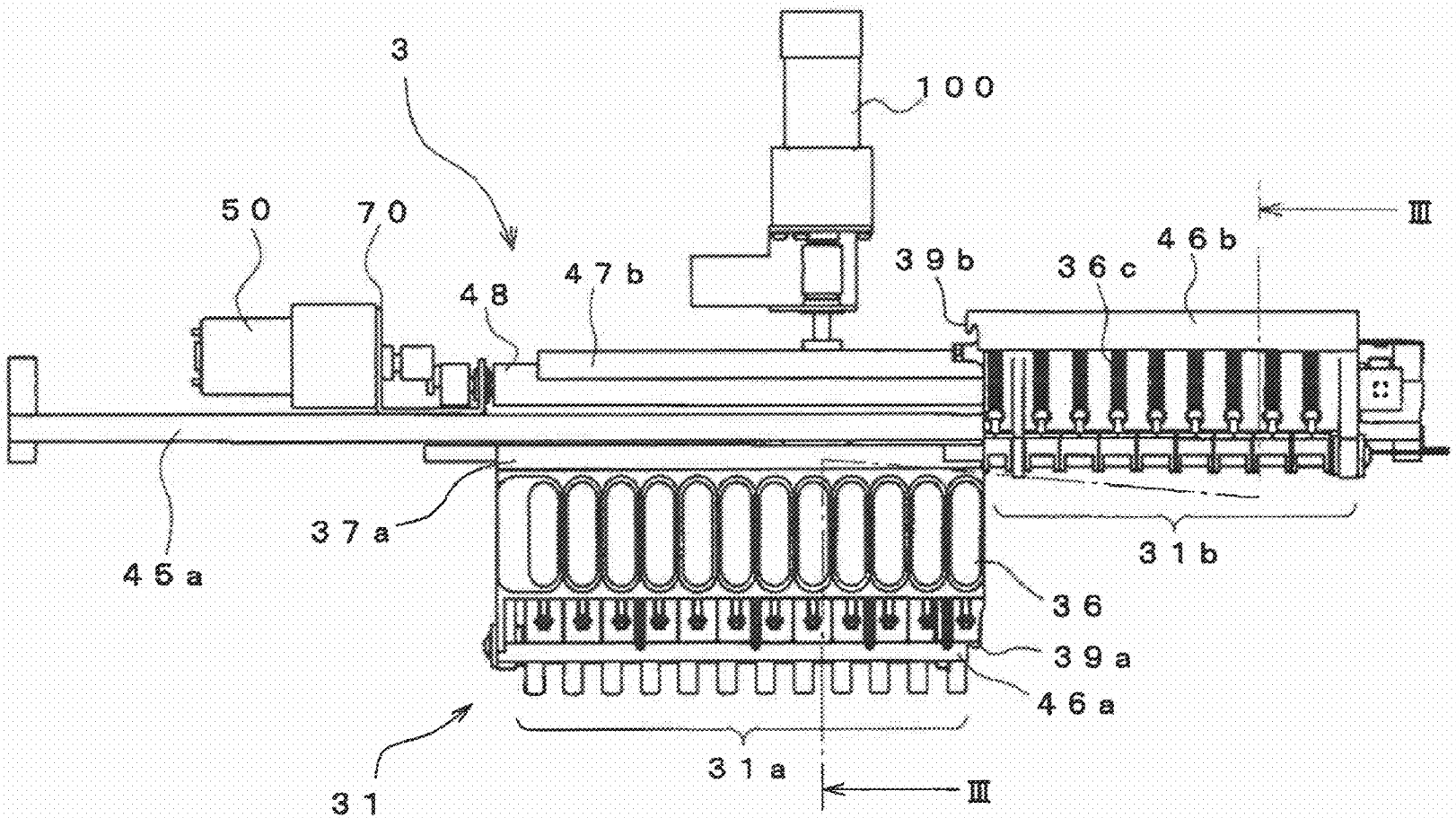
[FIG. 13] A plan view of the divisional container of FIG. 10 situated at a first movement terminal position and a second divisional container swung.
Figure 14:
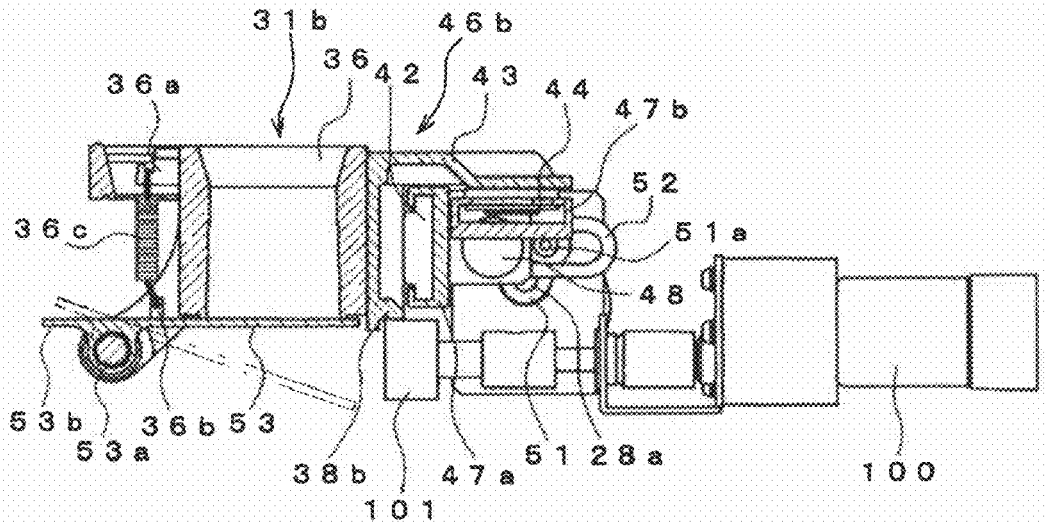
[FIG. 14] A sectional view taken along the line II-II of FIG. 12.
Figure 15:
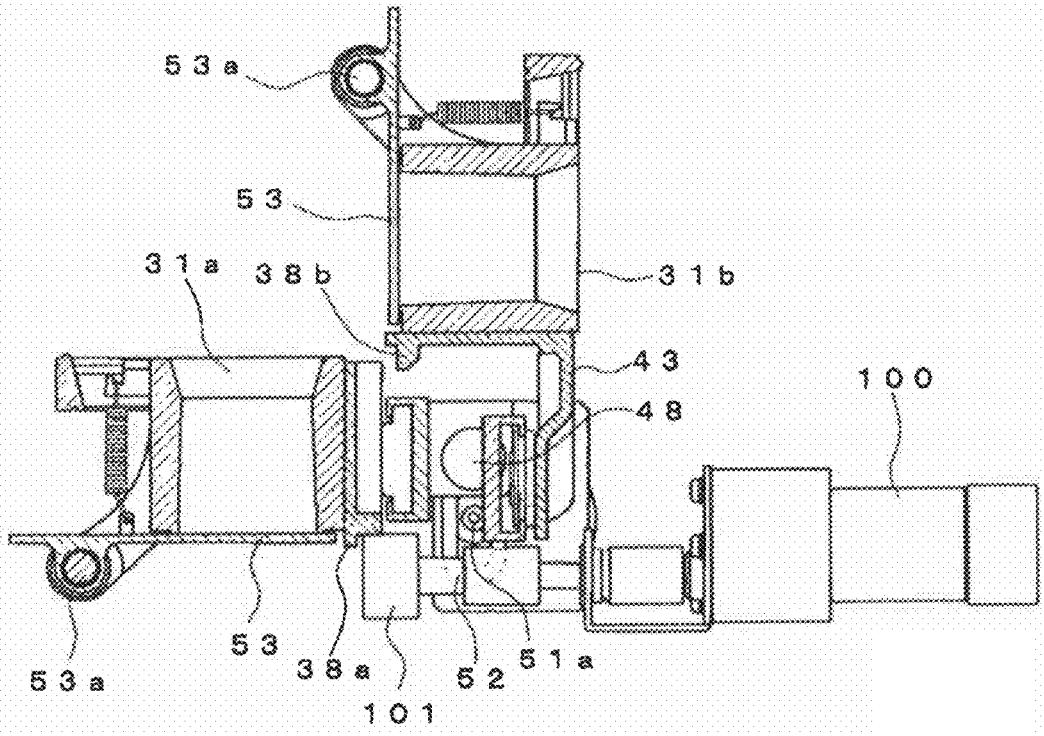
[FIG. 15] A sectional view taken along the line III-III of FIG. 13.
Figure 16:
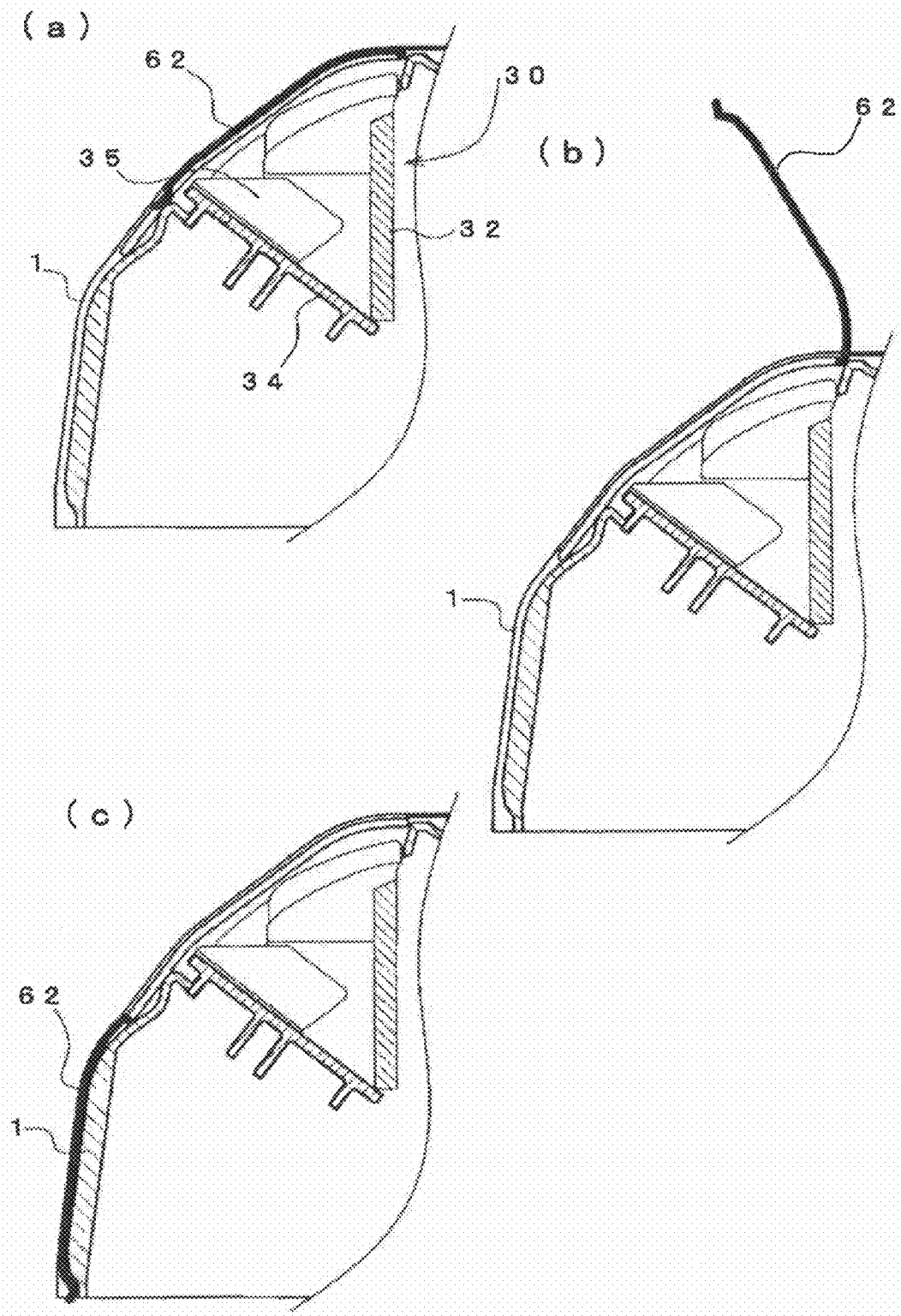
[FIGS. 16] Partial sectional views of an apparatus main body for showing the first cover.
Figure 17:
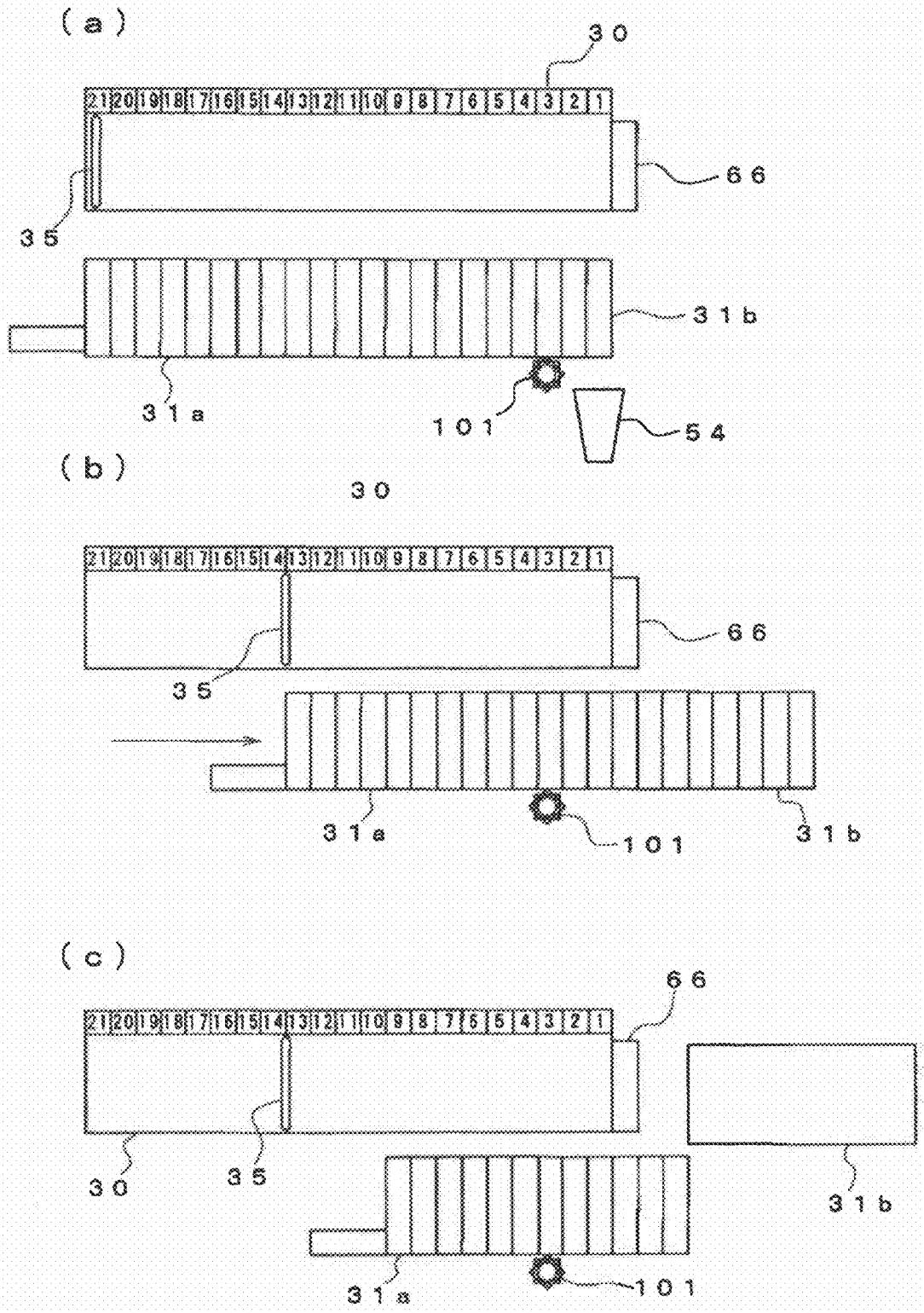
[FIGS. 17] Schematic explanatory view showing an example of the divisional container movement.
Figure 18:
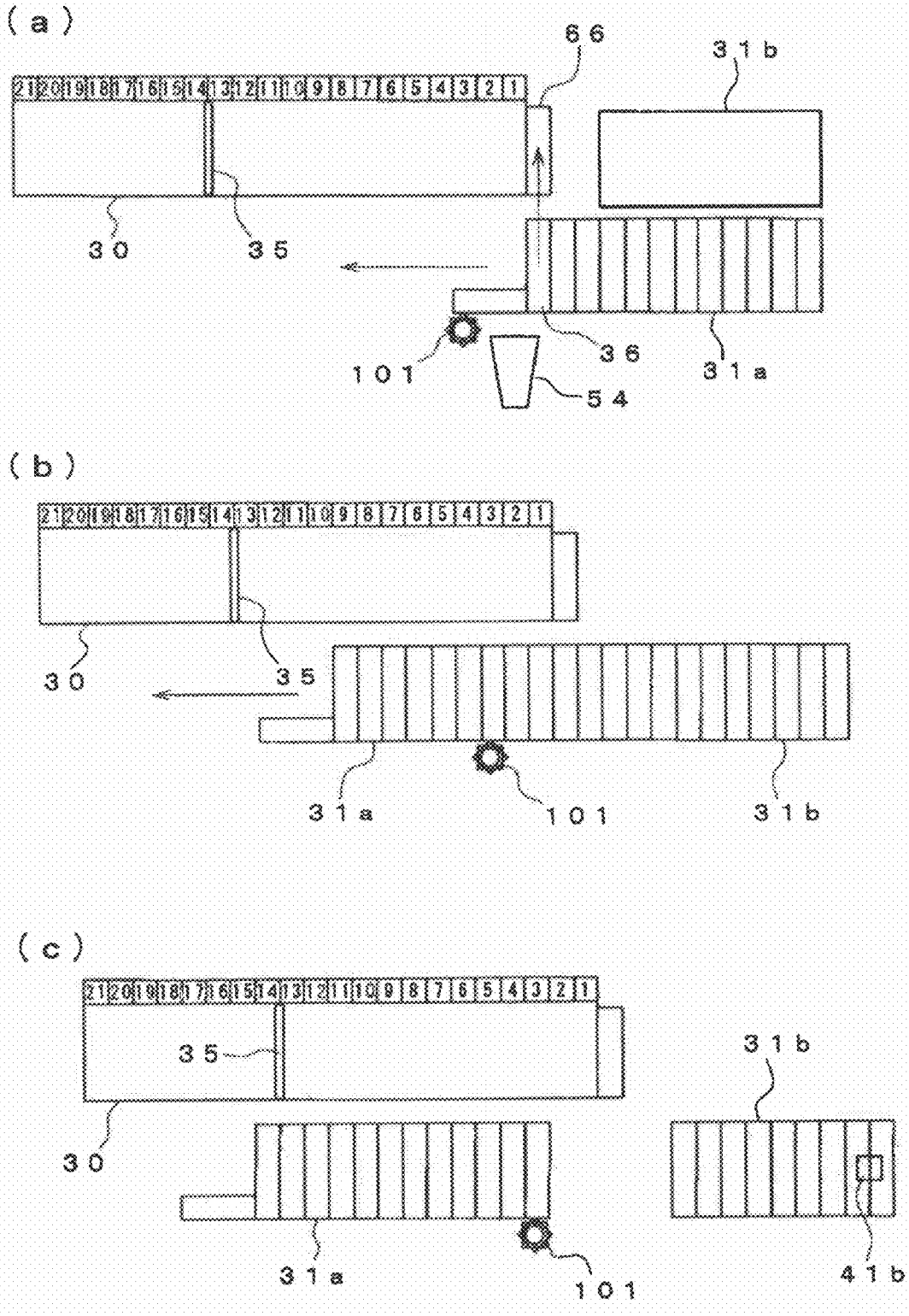
[FIGS. 18] Schematic explanatory view showing an example of the divisional container movement.

1 . . . apparatus main body
2 . . . tablet feed unit (tablet feed means)
3 . . . powder medicine feed unit (powder medicine feed means)
4 . . . dispensing/packaging unit (dispensing/packaging means)
5 . . . tablet accommodation member
6 . . . holding member
7 . . . tablet accommodation part
8 . . . tablet dispenser box
9 . . . flange portion
10 . . . support wall
11 . . . lock portion
12 . . . base portion
13 . . . bottom plate
14 . . . weight
15 . . . holding part
16 . . . side plate
17 . . . connection plate
18 . . . shaft member
19 . . . detection member
20 . . . support roller
21 . . . rectangular hole
22 . . . lock reception portion
23 . . . first rack gear
24 . . . pinion gear
25 . . . intermediate gear
26 . . . drive gear
27 . . . feed motor
28 . . . rotation shaft
29 . . . detection disc
30 . . . V-shaped dispenser box
31 . . . divisional container
32 . . . vertical plate
33 . . . end plate
34 . . . opening/closing plate
35 . . . partition triangular plate
36 . . . powder medicine accommodation part
37 . . . bracket
38 . . . second rack gear
39 . . . connecting portion
40*a*, 40*b*, 40*c* . . . portion to be detected
41*a*, 41*b* . . . detection sensor
42 . . . guide protrusion
43 . . . support plate
44 . . . guide roller
45 . . . guide member
46*a* . . . first guide portion
46*b* . . . second guide portion
47 . . . slide rail
48 . . . guide shaft
49 . . . mounting plate
50 . . . swinging motor
51 . . . link
52 . . . elongated ring
53 . . . bottom plate

54 . . . hopper
55 . . . seal portion
56 . . . frame member
57 . . . guide groove
58 . . . support panel (supporting means)
59 . . . outer peripheral wall
60 . . . inner peripheral wall
61 . . . arcuate passage
62 . . . first cover
63 . . . second cover
64 . . . operation panel
65 . . . hose
66 . . . suction duct
67 . . . position detecting sensor
70 . . . support plate
80 . . . led
100 . . . feed motor
101 . . . pinion gear
110 . . . stationary sealing member
111 . . . movable sealing member
112 . . . roller frame
113 . . . heater roller
114 . . . bearing portion
115 . . . first heat portion
116 . . . second heat portion
117 . . . main gear
118 . . . sub gear
119 . . . protective cover
120 . . . abutment roller
121 . . . power supply canceling plate
122 . . . limit switch

The invention claimed is:

1. A powder medicine dispensing/packaging apparatus, comprising:

a divisional container having a first divisional container and a second divisional container configured to connect with each other and each including a plurality of powder medicine accommodation parts accommodating powder medicines in equal amounts corresponding to one package, each powder medicine accommodation part having a bottom part configured to open and close;

a carrying means for horizontally carrying the divisional container between an initial position and a first movement terminal position;

a dispensing/packaging means for recovering the powder medicines dropped from the divisional container carried by the carrying means by successively opening the bottom plates and dispensing/packaging the powder medicines package by package; and a swinging means for disconnecting the first and second divisional containers at the first movement terminal position to enable the first divisional container to move to a second movement terminal position and to swing the second divisional container to a retracted position.

2. A powder medicine dispensing/packaging apparatus of claim 1, wherein the first divisional container is supported and configured to reciprocate along a first slide rail, wherein the second divisional container is supported and configured to reciprocate along a second slide rail disposed in parallel with the first slide rail, and wherein the second slide rail is supported and configured to swing with respect to the first slide rail.

3. A powder medicine dispensing/packaging apparatus of claim 2, further including a means for determining that there is an error if, when moving the first divisional container from the second movement terminal position to the first movement terminal position, the second divisional container is located at the first movement terminal position as a result of moving the first divisional container to the initial position after restoring the second divisional container to the first movement terminal position from the retracted position.

4. A powder medicine dispensing/packaging apparatus of claim 1, further including a means for determining that there is an error if, when moving the first divisional container from the second movement terminal position to the first movement terminal position, the second divisional container is located at the first movement terminal position as a result of moving the first divisional container to the initial position after restoring the second divisional container to the first movement terminal position from the retracted position.

* * * * *